US009728888B1

(12) United States Patent
Ejiri et al.

(10) Patent No.: US 9,728,888 B1
(45) Date of Patent: Aug. 8, 2017

(54) SOCKET

(71) Applicant: SMK Corporation, Tokyo (JP)

(72) Inventors: Koichiro Ejiri, Kanagawa (JP); Haruhiko Kondo, Kanagawa (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 15/385,853

(22) Filed: Dec. 20, 2016

(30) Foreign Application Priority Data

Jun. 20, 2016 (JP) ..... 2016-121421

(51) Int. Cl.
*H01R 13/52* (2006.01)
*H01R 12/72* (2011.01)

(52) U.S. Cl.
CPC ..... *H01R 13/5219* (2013.01); *H01R 12/721* (2013.01)

(58) Field of Classification Search
CPC ..... H01R 13/5202; H01R 13/5219; H01R 13/5221
USPC ..... 439/630
See application file for complete search history.

(56) References Cited

U.S. PATENT DOCUMENTS

2016/0072209 A1* 3/2016 Triplett ..... H01R 12/7076 439/587

FOREIGN PATENT DOCUMENTS

JP 2007-258041 A 10/2007
JP 2012-238481 A 12/2012

* cited by examiner

*Primary Examiner* — Ross Gushi

(57) ABSTRACT

Provided is a socket which hermetically seals a contact space in which plug-side contacts and socket-side contacts are in contact with each other by a small-scale simple structure. The socket includes an elastic seal member that surrounds one or a plurality of socket-side contacts, is fixed to an inner surface of an accommodation recess, and makes elastic contact with an exposure surface of a plug connection portion accommodated in the accommodation recess, a plug-side contact or contacts being exposed in the exposure surface. A contact space in which the plug-side contact(s) of the plug connection portion slid to a connection position in the accommodation recess and a contact portion or portions of the corresponding contact-side contact(s) make elastic contact with each other is surrounded and hermetically sealed by the inner surface of the accommodation recess, the elastic seal member, and the exposure surface of the plug connection portion.

8 Claims, 26 Drawing Sheets

SOCKET

CROSS REFERENCE TO RELATED APPLICATION

The contents of the following Japanese patent application are incorporated herein by reference, Japanese Patent Application No. 2016-121421 filed on Jun. 20, 2016.

FIELD

The present invention relates to a socket which puts a contact into contact with a conductive pad of a counterpart plug connection portion to establish electrical connection, and more particularly to a socket which hermetically seals a contact area between the conductive pad and the contact from outside.

BACKGROUND

A socket which puts contact portions of socket-side contacts exposed in an accommodation recess into contact with plug-side contacts exposed in one surface of a counterpart plug connection portion accommodated in the accommodation recess to establish electrical connection with the plug connection portion may be expected to be used in an inferior environment. Examples of the inferior environment include outdoors where the socket is exposed to dust and the weather, and bathrooms and kitchens where the socket is exposed to water droplets and dust. There has been known a socket that hermetically seals a contact space in which the plug-side contacts and the socket-side contacts are in contact with each other from outside so that water droplets, dust, or the like may not get into the contact space to cause poor contact and the like (Patent Literature 1).

Such a socket 100 described in Patent Literature 1, which hermetically seals the contact space from outside, will be described below with reference to FIGS. 24A, 24B, and 25. The socket 100 includes an insulating housing 101 and a plurality of socket-side contacts 102, 102, . . . which are insulated from each other and fixed to the insulating housing 101. The insulating housing 101 includes a housing main body 101*a*, a tongue piece 101*b*, and a partition plate 101*c*. The housing main body 101*a* has a rectangular cylindrical shape. The partition plate 101*c* partitions a rectangular cylindrical hole of the rectangular cylindrical housing main body 101*a*. The tongue piece 101*b* is horizontally protruded forward from the partition plate 101*c* toward a counterpart plug connection portion inserted.

Each socket-side contact 102 is integrally insert-molded to run through the partition plate 101*c* when the tongue piece 101*b* and the partition plate 101*c* are integrally molded of an insulating synthetic resin. A contact portion 102*a* at one end side is exposed in a flat surface side of the tongue piece 101*b*. A leg portion 102*c* to be soldered to a pattern of a printed wiring board is protruded in a crank shape from the bottom side of the partition plate 101*c* and fixed to the housing 101.

The outline of the rectangular partition plate 101*c* is configured to fit to the rectangular cylindrical hole of the housing main body 101*a*. A locking protrusion 103 protruded from a flat surface of the partition plate 101*c* is locked to a locking hole 104 formed in a rear portion of a flat surface of the housing main body 101*a*, whereby the partition plate 101*c* is fixed to the housing main body 101*a* to cover an opening in the rear of the housing main body 101*a*.

As shown in FIGS. 24A and 24B, an 0 ring 105 is arranged around the entire outer periphery of the rectangular partition plate 101*c*. The 0 ring 105 is in close contact with and interposed between the inner wall surface of the rectangular cylindrical hole of the housing main body 101*a* and the partitioning plate 101*c* fixed inside. The housing main body 101*a* and the outer periphery of the partition plate 101*c* are thereby hermetically sealed without a gap.

The partition plate 101*c* covers the opening in the rear of the rectangular cylindrical hole of the housing main body 101*a*, whereby an accommodation recess 106 for inserting and accommodating the counterpart plug connection portion into the insulating housing 101 from the front is formed as shown in FIG. 25. The tongue piece 101*b* with the contact portions 102*a* of the socket-side contacts 102 located in its flat surface protrudes into the accommodation recess 106 along a horizontal plane.

The accommodation recess 106 in which the contact portions 102*a* of the socket-side contacts 102 are located is hermetically sealed from outside without a gap, except a front opening 106*a*. With the counterpart plug connection portion inserted from the opening 106*a* and accommodated in the accommodation recess 106, the contact space in which the plug-side contacts (not shown) of the plug connection portion and the contact portions 102*a* of the socket-side contacts 102 are in contact with each other is thus hermetically sealed from outside, and water droplets or dust will not get into the contact space.

However, if a plug connection portion having no gap around is attempted to be inserted into the completely-sealed accommodation recess 106, the air inside the accommodation recess 106 is not let out and produces high internal pressure which interferes with the insertion of the plug connection portion. A gap therefore needs to be formed to let the air out of the accommodation recess 106 when the plug connection portion is inserted. A socket described in Patent Literature 2 includes a seal member that is interposed to cover a gap between the outer peripheral surface of the plug connection portion and the inner wall surface of the accommodation recess when the plug connection portion is inserted deepest into the accommodation recess, whereby the contact space is hermetically sealed.

CITATION LIST

Patent Literature

Patent Literature 1: Japanese Patent Application Laid-Open No. 2012-238481

Patent Literature 2: Japanese Patent Application Laid-Open No. 2007-258041

SUMMARY

Technical Problem

The related sockets described in the foregoing Patent Literatures 1 and 2 have a structure for hermetically sealing the entire accommodation recess except the opening. If there is a gap between the plug connection portion inserted in the accommodation recess and the inner wall surface of the accommodation recess, a seal member also needs to be arranged therebetween. This makes the structure for hermetically sealing the contact space large in scale and complicated.

To position the plug connection portion to a connection position in the accommodation recess, an engagement hole to be engaged with an engagement protrusion of the plug connection needs to be formed in the accommodation recess. A special contrivance to seal the engagement hole has therefore been needed to hermetically seal the interior of the accommodation recess in the presence of the engagement hole.

The structure for completely sealing the accommodation recess except the opening cannot discharge water droplets or dust intruded into the accommodation recess from outside through the opening when the plug connection portion is not accommodated. The water droplets and dust remain in the contact space if the plug connection portion is accommodated. This has been a cause of a connection failure between the plug-side contacts and the socket-side contacts.

To insert the plug connection portion into the completely-sealed accommodation recess, a passage through which the accommodation recess communicates with outside needs to be provided between the plug connection portion and the accommodation recess. This has needed the provision of another seal member to prevent intrusion of water droplets or dust through the passage.

The present invention has been achieved in view of the foregoing problems. It is thus an object of the present invention to provide a socket which hermetically seals the contact space by a small-scale simple structure.

Another object of the present invention is to provide a socket having high connection reliability, in which water droplets and dust remaining in the accommodation recess, if any, will not intervene between the plug-side contacts and the socket-side contacts.

Solution to Problem

To achieve the foregoing objects, a socket according to a first aspect is a socket including: a housing in which an accommodation recess is formed, the accommodation recess accommodating a counterpart plug connection portion having one or a plurality of plug-side contacts exposed in one surface in a freely slidable manner along the one surface as an exposure surface of the plug connection portion; and one or a plurality of socket-side contact(s) that is/are passed through a connection area of an inner surface of the accommodation recess and fixed to the housing, the inner surface being opposed to the exposure surface of the plug connection portion in the accommodation recess, the plug-side contact(s) exposed in the exposure surface of the plug connection portion slid to a connection position in the accommodation recess being put in contact with a contact portion or portions of the corresponding socket-side contact(s) protruding from the connection area into the accommodation recess, the socket including an elastic seal member that surrounds the one or plurality of socket-side contacts fixed to the connection area, is fixed to the inner surface of the accommodation recess, and makes elastic contact with the exposure surface of the plug connection portion accommodated in the accommodation recess, wherein a contact space in which the plug-side contact(s) of the plug connection portion slid to the connection position in the accommodation recess and the contact portion(s) of the corresponding socket-side contact(s) make elastic contact with each other is surrounded and hermetically sealed by the inner surface of the accommodation recess, the elastic seal member, and the exposure surface of the plug connection portion.

The plug-side contact(s) of the plug connection portion slide(s) in the accommodation recess along the exposure surface and make(s) sliding contact with the corresponding socket-side contact(s) protruding from the connection area of the inner surface of the accommodation recess opposed to the exposure surface. If the plug connection portion slides to the connection position, the plug-side contact(s) and the contact portion(s) of the corresponding socket-side contact(s) make elastic contact with each other. The contact space is surrounded and hermetically sealed from outside by the inner surface of the accommodation recess, the elastic seal member, and the exposure surface of the plug connection portion.

A socket according to a second aspect is configured such that: the elastic seal member is formed by stacking a plurality of ring frame members each surrounding the one or plurality of socket-side contacts fixed to the connection area; and any one of the ring frame members integrally includes an insulating plate that covers the connection area inside where is surrounded by the ring frame member, the insulating plate having one or a plurality of guide holes for the one or plurality of socket-side contacts protruding from the connection area into the accommodation recess to be inserted through, respectively.

The one or plurality of socket-side contacts fixed to the connection area protrude(s) into the accommodation recess through the guide hole(s) of the insulating plate, respectively. Even if the socket-side contacts make sliding contact with the exposure surface of the plug connection portion sliding in the accommodation recess, the socket-side contacts therefore are not in contact with each other and the contact portions are located in the movement loci of the corresponding plug-side contacts.

A socket according to a third aspect is configured such that a gap between a leg portion or portions of the socket-side contact(s) and the housing is sealed by a sealing material, the leg portion(s) being passed through an outer surface of the housing from the contact area of the inner surface of the accommodation recess and fixed to the housing.

Since the gap between the housing through which the leg portion(s) of the socket-side contact(s) is/are passed and the leg portion(s) is sealed by the sealing material, the contact space is more tightly sealed from outside.

A socket according to a fourth aspect is configured such that: either one of a flat surface and a bottom surface of the plug connection portion formed in a plate shape along a direction of insertion into the accommodation recess serves as the exposure surface; the accommodation recess guides and accommodates the plug connection portion inserted in the direction of insertion up to the connection position in parallel with the exposure surface; and the contact space in which the plug-side contact(s) of the plug connection portion inserted to the connection position in the accommodation recess and the contact portion(s) of the corresponding socket-side contact(s) are in contact with each other is surrounded and hermetically sealed by the inner surface of the accommodation recess, the elastic seal member, and the exposure surface of the plug connection portion.

The plug-side contact(s) of the plug connection portion is/are inserted into the accommodation recess along the flat surface or the bottom surface of the plug connection portion formed in the plate shape, compress(es) and cross(es) over the elastic seal member fixed to an inner top surface or an inner bottom surface of the accommodation recess opposed to the flat surface or the bottom surface of the plug connection portion, and make(s) sliding contact with the corresponding socket-side contact(s) protruding from the connection area. If the plug connection portion is inserted to the connection position, the plug-side contact(s) and the contact portion(s) of the corresponding socket-side contact(s) make elastic contact with each other. The contact space is surrounded and hermetically sealed from outside by the inner top surface or the inner bottom surface of the accommodation recess, the elastic seal member, and the flat surface or the bottom surface of the plug connection portion.

A socket according to a fifth aspect is configured such that an inclined surface sloping toward the exposure surface of the plug connection portion along the direction of insertion of the plug connection portion is formed on a front surface of the elastic seal member facing the plug connection portion inserted into the accommodation recess.

The extremity of the plug connection portion inserted along the inner surface of the accommodation recess comes into contact with the inclined surface, and presses the elastic seal member toward the inner surface while being inserted into the accommodation recess beyond the elastic seal member.

A socket according to a sixth aspect is configured such that an opposed surface opposed to the inner surface in the accommodation recess is a metal cover formed by bending a conductive metal plate.

Since the opposed surface of the accommodation recess is made of a metal cover, the housing in which the accommodation recess is formed has certain strength. The metal cover is grounded, so that the contact space in which the contacts are in contact with each other is shielded from outside by the opposed surface of the accommodation recess covered by the metal cover.

A socket according to a seventh aspect is configured such that: the plug connection portion includes a cylindrical body that has a cylindrical outer side surface having a flange portion protruded thereon and a bottom surface serving as the exposure surface; the housing includes a cylindrical accommodation recess that rotatably guides and accommodates the plug connection portion about a center axis thereof and a cover that protrudes into the cylindrical accommodation recess on a flat surface side of the flange portion of the plug connection portion rotated to a connection position in the cylindrical accommodation recess, the cylindrical accommodation recess and the cover being formed out of a circular bottom surface portion that has an inner bottom surface serving as the inner surface opposed to the exposure surface and a cylindrical peripheral wall portion that is erected around the circular bottom surface portion; and the contact space in which the plug-side contact(s) of the plug connection portion rotated to the connection position in the cylindrical accommodation recess and the contact portion(s) of the corresponding socket-side contact(s) are in contact with each other is surrounded and hermetically sealed by the inner bottom surface of the cylindrical accommodation recess, the elastic seal member, and the exposure surface of the plug connection portion.

The plug-side contact(s) exposed in the bottom surface of the cylindrical plug connection portion slide(s) about the center axis along the inner bottom surface of the cylindrical accommodation recess, and make(s) sliding contact with the corresponding socket-side contact(s) protruding from the connection area. If the plug connection portion is rotated to the connection position, the cover protruding toward the flat surface of the flange portion restricts the movement of the plug connection portion to the flat surface side. The contact portion(s) of the socket-side contact(s) make(s) elastic contact with the plug-side contact(s) exposed in the bottom surface of the plug connection portion. The contact space in which the contact portion(s) of the socket-side contact(s) and the plug-side contact(s) make elastic contact with each other is surrounded and hermetically sealed from outside by the inner bottom surface of the cylindrical accommodation recess, the elastic seal member, and the bottom surface of the plug connection portion.

A socket according to an eighth aspect is configured such that the cover is a metal cover formed by bending a conductive metal plate.

Since the cover covering the flat surface side of the flange portion is made of a metal cover, the cover protruding from part of the cylindrical peripheral wall portion about the center axis into the cylindrical accommodation recess has certain strength.

According to the invention of the first aspect, the exposure surface of the plug connection portion accommodated in the accommodation recess is used to hermetically seal the contact space in which the plug-side contact(s) and the contact portion(s) of the socket-side contact(s) are in contact with each other. The intrusion of water droplets and dust into the contact space can thus be prevented by the simple configuration of providing the elastic seal member on the inner surface of the accommodation recess. Even if the plug connection portion is connected to the socket in an inferior atmosphere, the contact surfaces of the contacts will not be eroded further and poor contact is less likely to occur.

A through hole, such as an engagement hole to be engaged with the plug connection portion, or a gap may be formed in part of the accommodation recess to make the plug connection portion freely slidable in the accommodation recess without the entire accommodation recess being hermetically sealed. Even in such a case, the contact space in which the plug-side contact(s) and the contact portion(s) of the socket-side contact(s) are in contact with each other can be hermetically sealed from outside.

If the accommodation recess is not formed in a hermetically sealed structure and has a gap, water droplets and dust intruded when the plug connection portion is not accommodated can be discharged from the gap. This prevents insulators from intervening between the plug-side contact(s) and the contact portion(s) of the socket-side contact(s) to cause a connection failure.

According to the invention of the second aspect, the one or plurality of socket-side contacts are positioned in the guide hole(s) and prevented from being in contact with each other even if the exposure surface of the plug connection portion sliding in the accommodation recess makes sliding contact with the socket-side contact(s). The contact portion(s) of the socket-side contact(s) can thus reliably make elastic contact with the plug-side contact(s) in the connection position.

According to the invention of the third aspect, the gap between the leg portion(s) of the socket-side contact(s) and the housing is sealed by the sealing material without the socket-side contact(s) being insert-molded with the housing. The contact space can thus be more tightly sealed from outside.

According to the invention of the fourth aspect, the flat surface or the bottom surface of the plug connection portion accommodated in the accommodation recess is used to hermetically seal the contact space in which the plug-side contact(s) and the contact portion(s) of the socket-side contact(s) are in contact with each other. The intrusion of water droplets and dust into the contact space can thus be prevented by the simple configuration of providing the elastic seal member on the inner bottom surface or the inner top surface of the accommodation recess.

Since the entire accommodation recess is not hermetically sealed, a through hole, such as an engagement hole to be engaged with the plug connection portion, or a gap can be formed in part of the accommodation recess, so that the plug connection portion can be freely inserted and removed into/from the accommodation recess.

In addition, a gap for discharging water droplets and dust intruded when the plug connection portion is not accommodated in the accommodation recess can be formed. This prevents insulators from intervening between the plug-side contact(s) and the contact portion(s) of the socket-side contact(s) to cause a connection failure.

According to the invention of the fifth aspect, when the plug connection portion is inserted into the accommodation recess beyond the elastic seal member, the elastic seal member undergoes force for pressing the elastic seal member toward the bottom surface to which the elastic seal member is fixed. This prevents exfoliation of the elastic seal member from the bottom surface.

According to the invention of the sixth aspect, the housing has certain strength. The metal cover can be grounded to shield the contact space from noise intruding into the contact space from the opposed surface side of the accommodation recess.

According to the invention of the seventh aspect, the bottom surface of the plug connection portion accommodated in the cylindrical accommodation recess can be used to hermetically seal the contact space in which the plug-side contact(s) and the contact portion(s) of the socket-side contact(s) are in contact with each other. The intrusion of water droplets and dust into the contact space can thus be prevented by the simple configuration of providing the elastic seal member on the inner bottom surface of the accommodation recess.

Since the entire cylindrical accommodation recess is not hermetically sealed, a through hole, such as an engagement hole to be engaged with the plug connection portion, or a gap can be formed in part of the cylindrical accommodation recess, so that the plug connection portion can be freely inserted and removed into/from the cylindrical accommodation recess.

In addition, a gap for discharging water droplets and dust intruded when the plug connection portion is not accommodated in the cylindrical accommodation recess can be formed. This prevents insulators from intervening between the plug-side contact(s) and the contact portion(s) of the socket-side contact(s) to cause a connection failure.

According to the invention of the eighth aspect, the cover protruding from part of the cylindrical peripheral wall portion about the center axis into the cylindrical accommodation recess has certain strength. The metal cover can be grounded to block noise intruding into the cylindrical accommodation recess from the direction covered by the metal cover.

DESCRIPTION OF EMBODIMENTS

A socket 1 according to a first embodiment of the present invention will be described below with reference to FIGS. 1 to 13.

Figure 12:
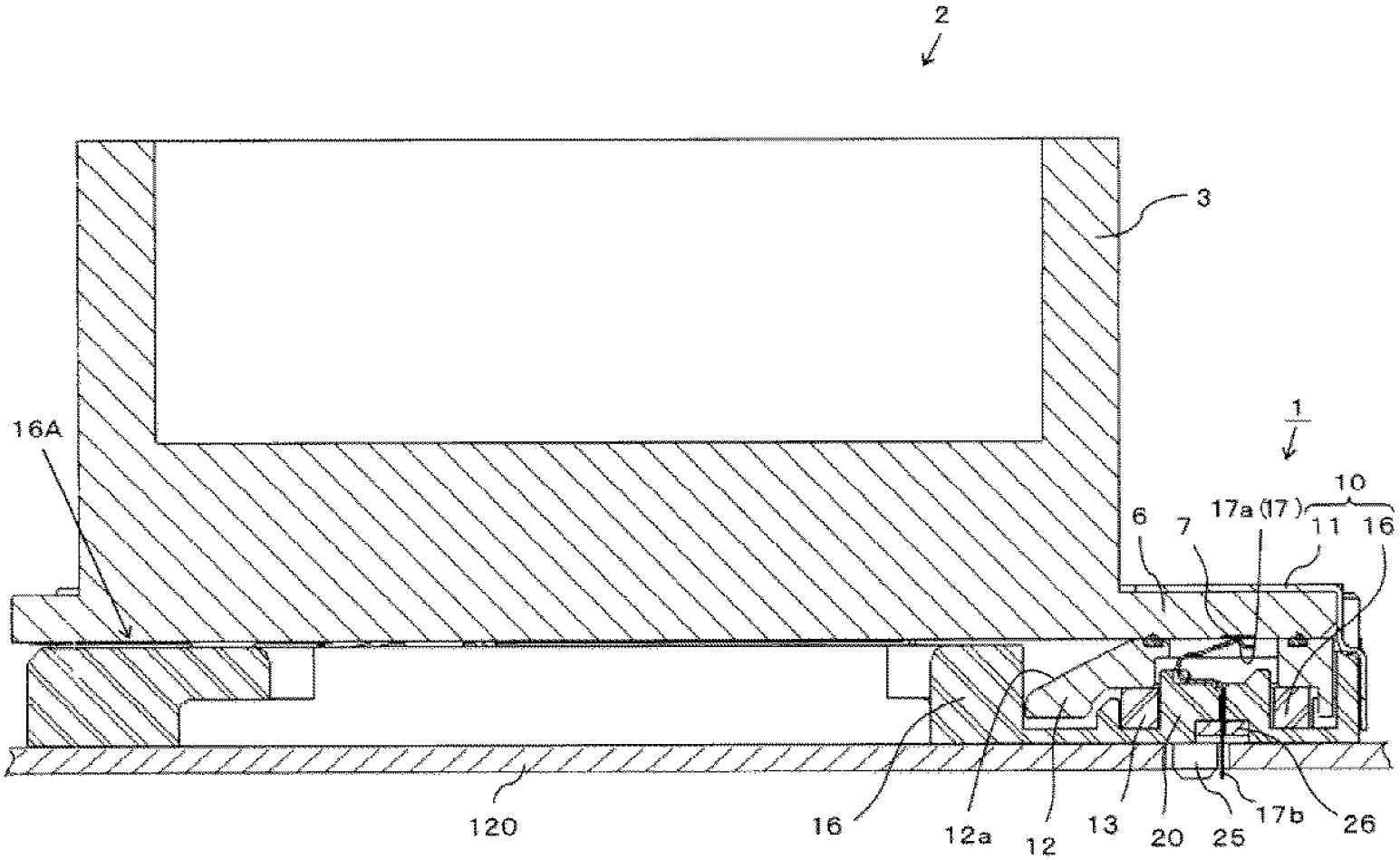
FIG. 12 is a longitudinal sectional view of FIG. 11, taken along the direction of insertion of the plug connection portion 6.

The socket 1 is electrically connected with an optical electronic part 2 in the following manner. As shown in FIG. 12, a plug connection portion 6 of an optical electronic part 2 is inserted into an accommodation recess 19 formed in a housing 10. Socket-side contacts (hereinafter, referred to as contacts) 17 protruded into the accommodation recess 19 are brought into contact with plug-side contacts (hereinafter, referred to as conductive pads) 7 located in the bottom surface of the plug connection portion 6. In the following description, the leftward direction in FIG. 12 will be referred to as backward, the rightward direction or the direction of insertion as forward, the vertical direction as a vertical direction, and the direction orthogonal to the plane of the diagram as a lateral direction.

Figure 1:
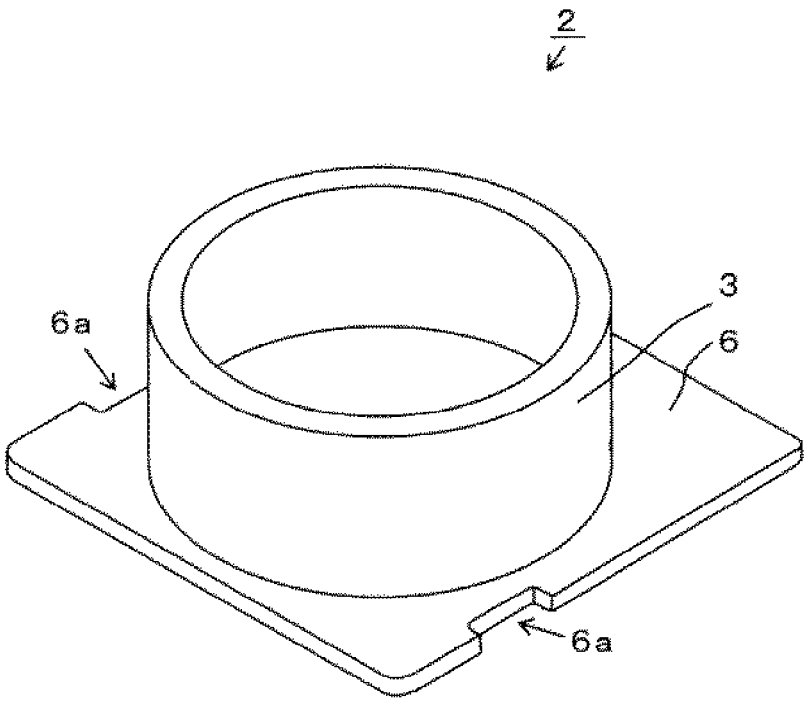
FIG. 1 is a perspective view of a counterpart optical electronic part 2 to be connected to a socket 1 according to a first embodiment of the present invention.
Figure 2:
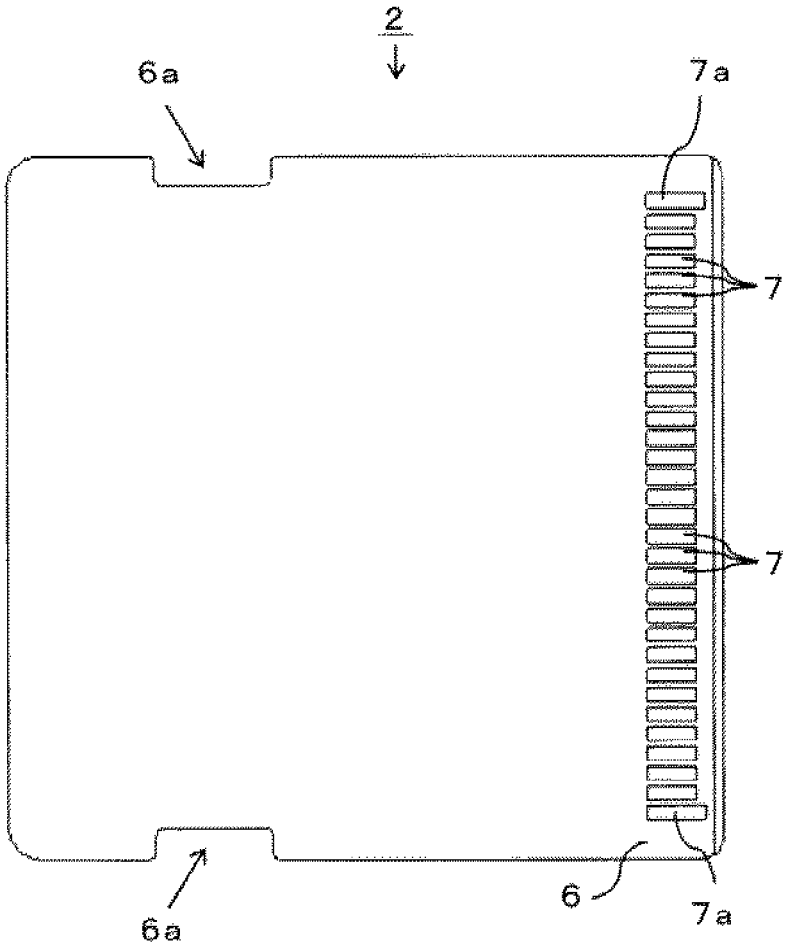
FIG. 2 is a bottom view of the optical electronic part 2.
Figure 3:
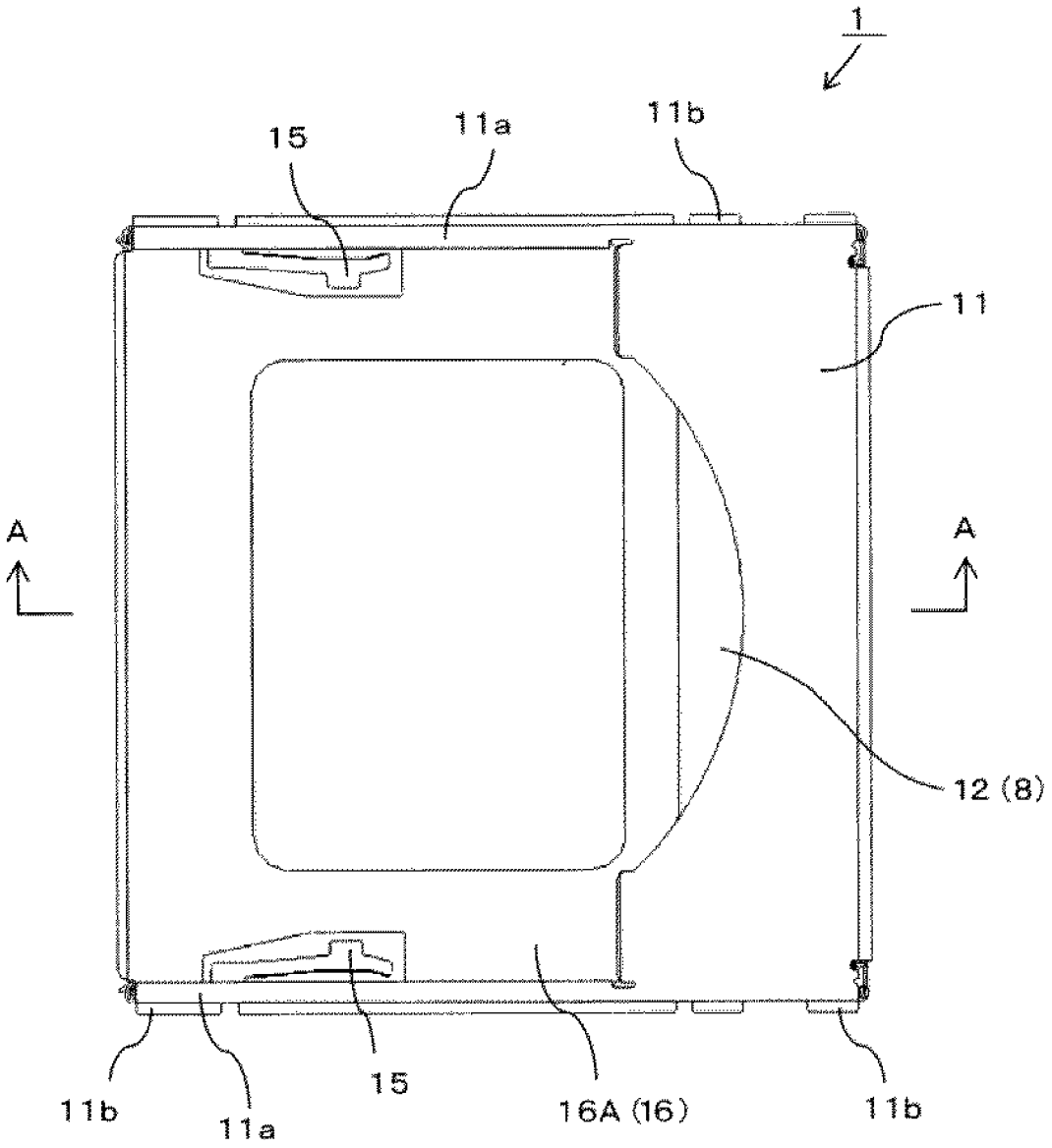
FIG. 3 is a plan view of the socket 1.
Figure 4:
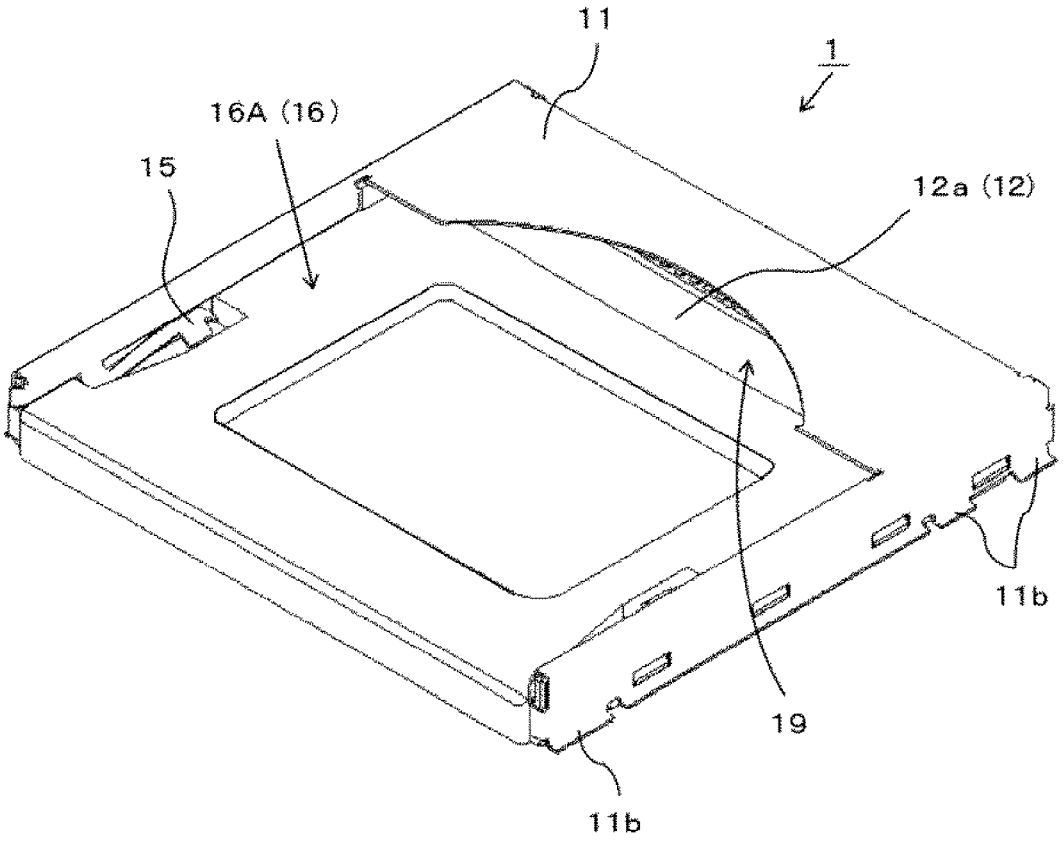
FIG. 4 is a perspective view of the socket 1.
Figure 5:
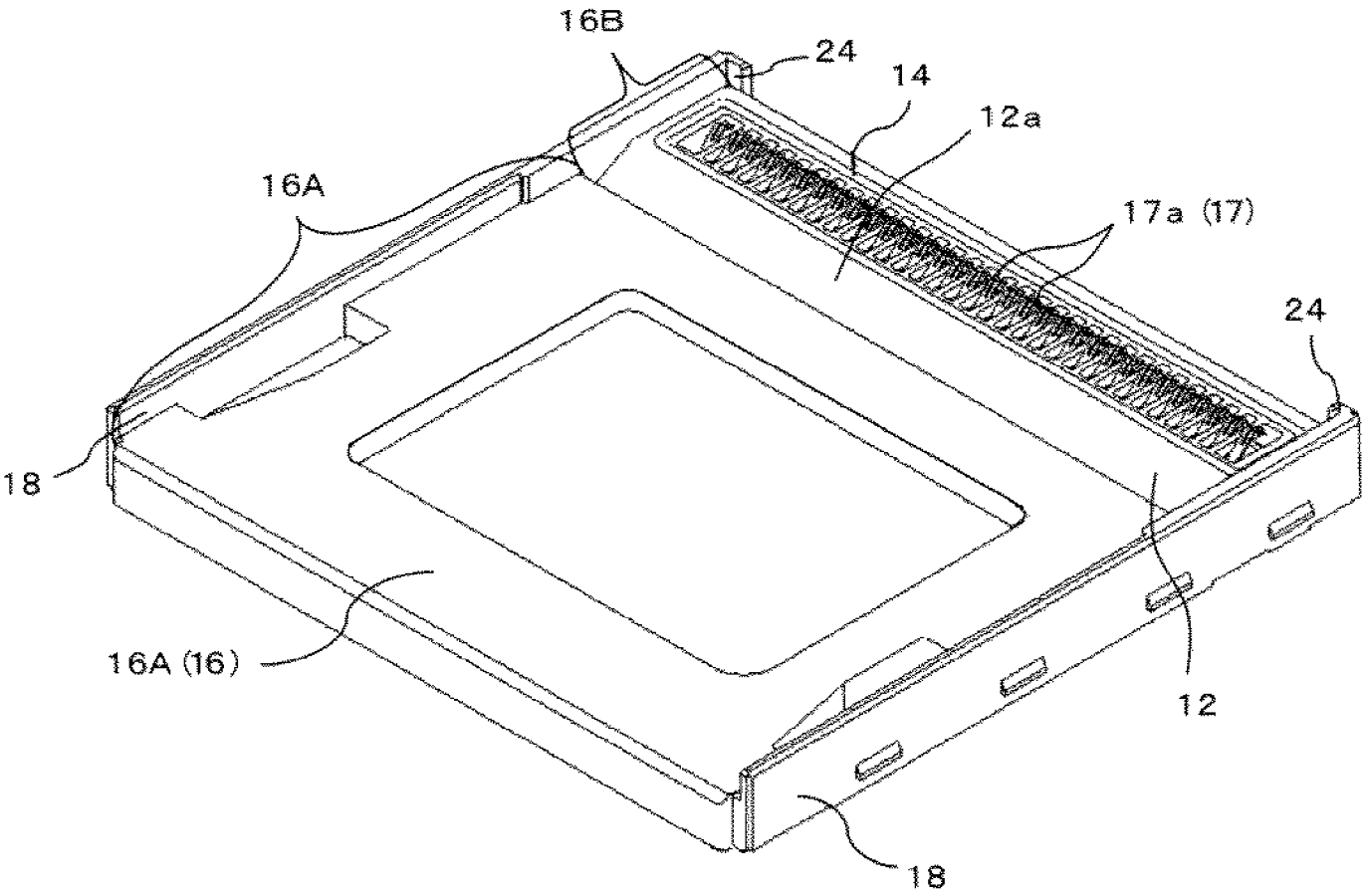
FIG. 5 is a perspective view of the socket 1 with a metal cover 11 removed.

The optical electronic part 2 to be connected to the socket 1 is a module in which a photoelectric conversion element, such as CCD and CMOS sensors, and optical components including a filter and a lens arranged on a light reception optical path thereof are built in an insulating case 3. As shown in FIGS. 1 and 2, the insulating case 3 has the shape of a cylinder on the bottom of which a rectangular plate is integrally formed. A front flange portion of the rectangular plate constitutes the plug connection portion 6 to be inserted into the accommodation recess 19.

As shown in FIG. 2, a large number of conductive pads 7, 7, . . . connected to the photoelectric conversion element are exposed in the bottom surface of the plug connection portion 6, each along the front-to-rear direction. Of these conductive pads 7, the ones at both left and right sides are connection detection conductive pads 7*a*, 7*a*. The front ends of the connection detection conductive pads 7*a*, 7*a* are exposed slightly in front of the other conductive pads 7. Engagement recesses 6*a*, 6*a* are formed in the left and right side surfaces of the rectangular plate. The engagement recesses 6*a*, 6*a* are engaged with a pair of engagement pieces 15, 15 to be described later on the socket 1 side when the plug connection portion 6 is inserted to a connection position in the accommodation recess 19 of the socket 1.

Figure 6:
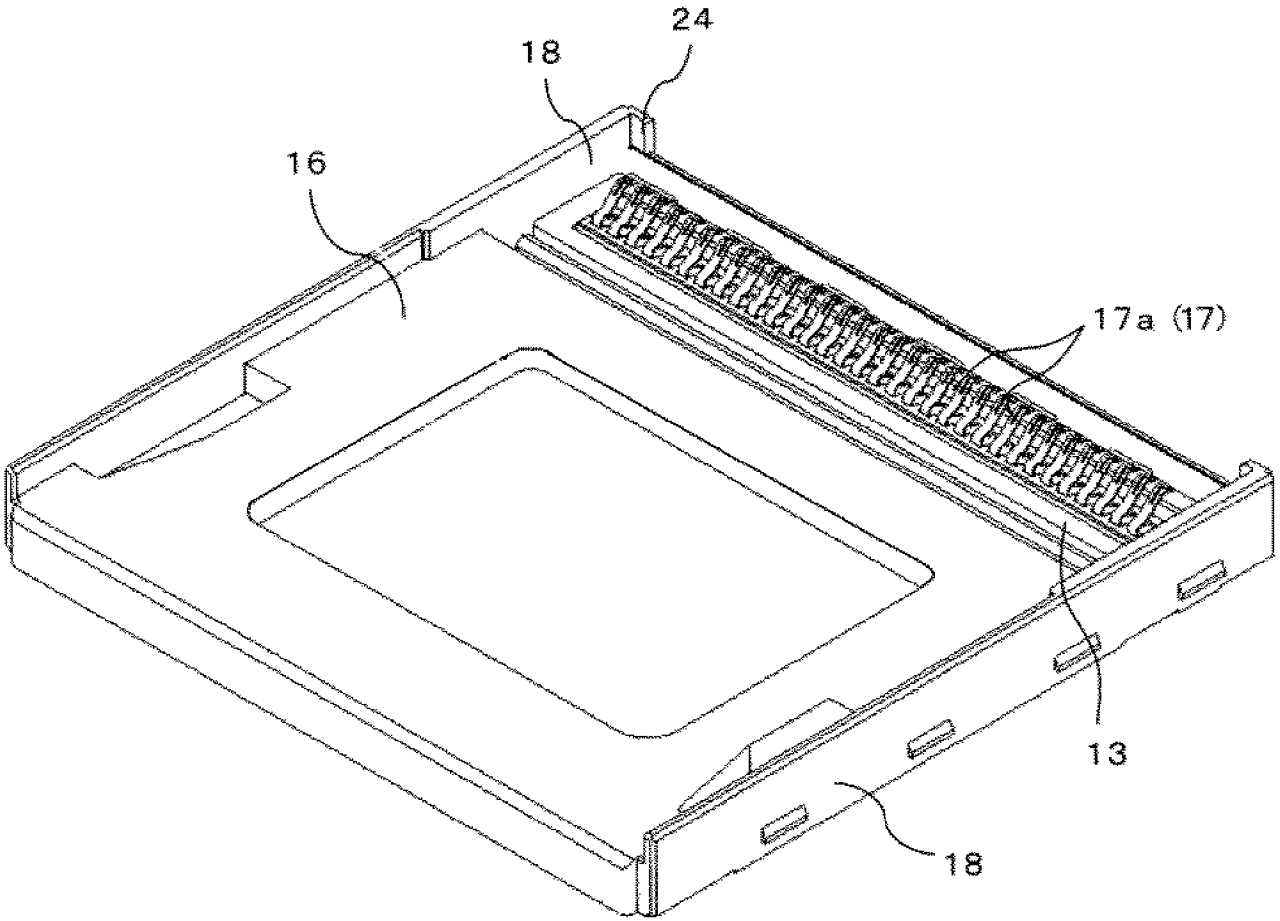
FIG. 6 is a perspective view of the socket 1 with the metal cover 11, a rectangular ring seal 14, and an upper elastic ring frame unit 12 removed.

The socket 1 includes a base housing 16 which is made of a synthetic resin, a metal cover 11 which covers a front portion of the base housing 16 from above, and the large number of contacts 17, 17, . . . which are passed through and fixed to the base housing 16. The base housing 16 and the metal cover 11 constitute the housing 10 of the socket 1 which is mounted on a printed wiring board 120. As shown in FIG. 6, the base housing 16 is formed in a flat rectangular plate shape. Guide walls 18, 18 for slidably guiding the plug connection portion 6 of the optical electronic part 2 therebetween in the front-to-rear direction are erected along the left and right sides of the base housing 16. The accommodation recess 19 which accommodates the plug connection portion 6 in a freely insertable and removable manner in the front-to-rear direction is formed in the front portion of the base housing 16 by the guide walls 18, 18 on both sides and the metal cover 11 covering the flat surface from above.

The plug connection portion 6 is accommodated in the accommodation recess 19 in a freely insertable and removable manner in the front-to-rear direction in such an orientation that an exposure surface in which the large number of conductive pads 7, 7, . . . are exposed is at the bottom. If the plug connection portion 6 is inserted up to the connection position shown in FIG. 12 in the accommodation recess 19, the inner bottom surface of the accommodation recess 19 opposed to the bottom surface (exposure surface) of the plug connection portion 6 serves as a connection area 16B through which the foregoing large number of contacts 17 are passed. The rear flat surface of the base housing 16 continuous with the connection area 16B serves as a part reception area 16A on which the plug connection portion 6 of the optical electronic part 2 is placed from above. The plug connection portion 6 can continuously slide over the part reception area 16A and the accommodation recess 19 in the front-to-back direction.

Figure 7:
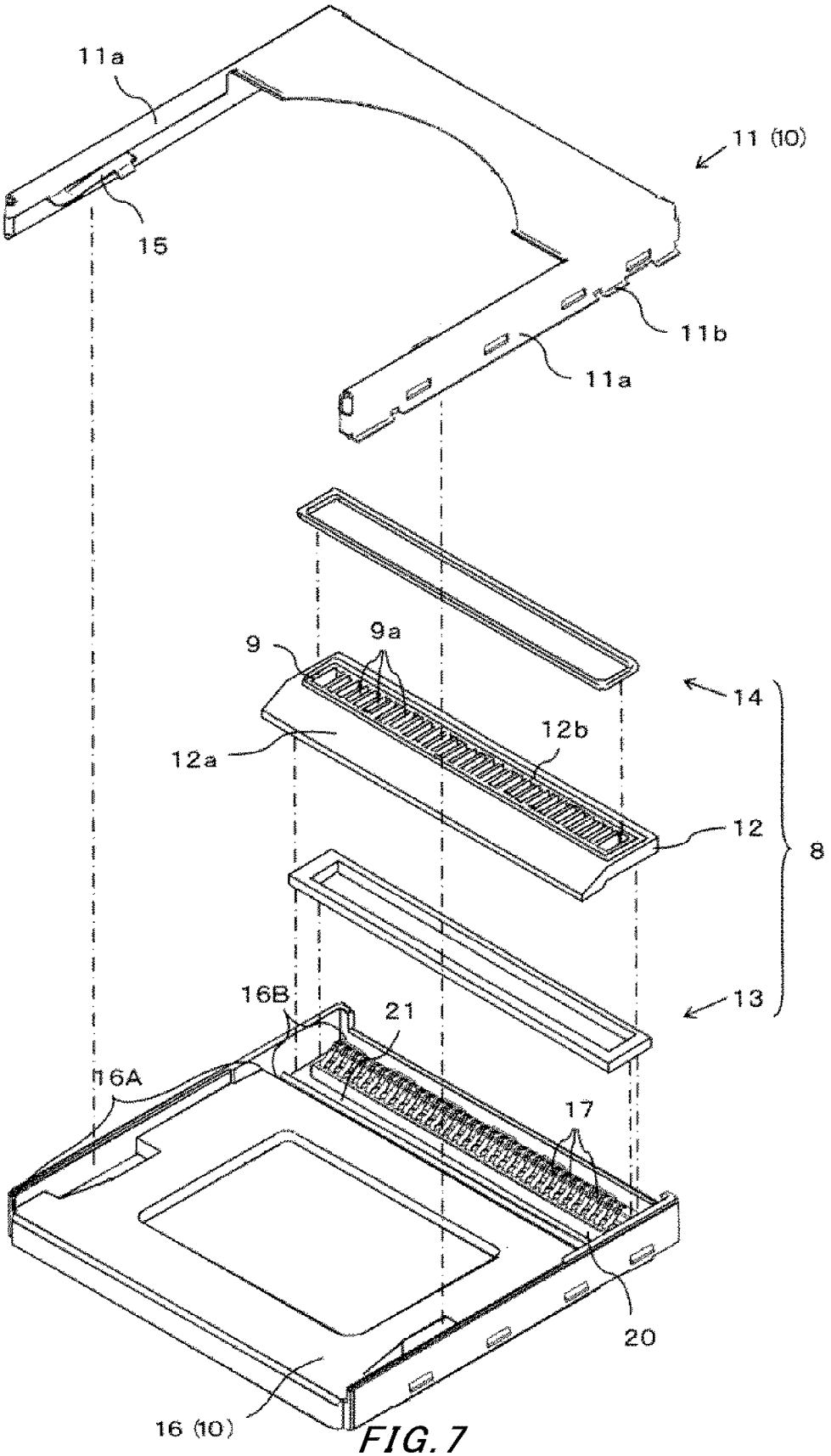
FIG. 7 is an exploded perspective view of main parts of the socket 1.

As shown in FIG. 7, the connection area 16B of the base housing 16 is formed to be thinner than the part reception area 16A behind. A rib 20 for supporting the large number of contacts 17 is formed to protrude upward from the center of the connection area 16B, with the lateral direction as its longitudinal direction. The vicinity of the rib 20 constitutes a seal mounting recess 21 of rectangular shape.

An elastic seal member 8 is arranged in the seal mounting recess 21. The elastic seal member 8 is formed by stacking ring frame members including a lower elastic ring frame unit 13, an upper elastic ring frame unit 12, and a rectangular ring seal 14 in order from below. The ring frame members of the elastic seal member 8 are each made of a synthetic resin. Of these, the upper elastic ring frame unit 12 has an inclined surface 12*a* on its rear flat surface. The inclined surface 12*a* slopes upward toward the front. When the plug connection portion 6 is inserted into the accommodation recess 19, the front end of the plug connection portion 6 sliding forward in the direction of insertion comes into contact with the inclined surface 12*a*. The upper elastic ring frame unit 12 is pressed down to compress the lower elastic ring frame unit 13.

The inside surrounded by the ring frame of the upper elastic ring frame unit 12 is covered by an insulating plate 9 which is integrally molded with the upper elastic ring frame unit 12. A large number of guide slits 9*a* oblong in the front-to-rear direction are formed in the insulating plate 9. The guide slides 9*a* are formed in positions opposed to the rib 20 of the connection area 16B for protruding the large number of contacts 17 into the accommodation recess 16, the positions corresponding to respective positions where the large number of contacts 17 are protruded. As a result, the large number of contacts 17 are inserted through the respective corresponding guide slits 9*a* and laterally positioned to not be in contact with each other. Contact portions 17*a* at the free end side are guided to swing in the front-to-rear direction along the movement loci of the corresponding conductive pads 7 of the plug connection portion 6.

Figure 13:
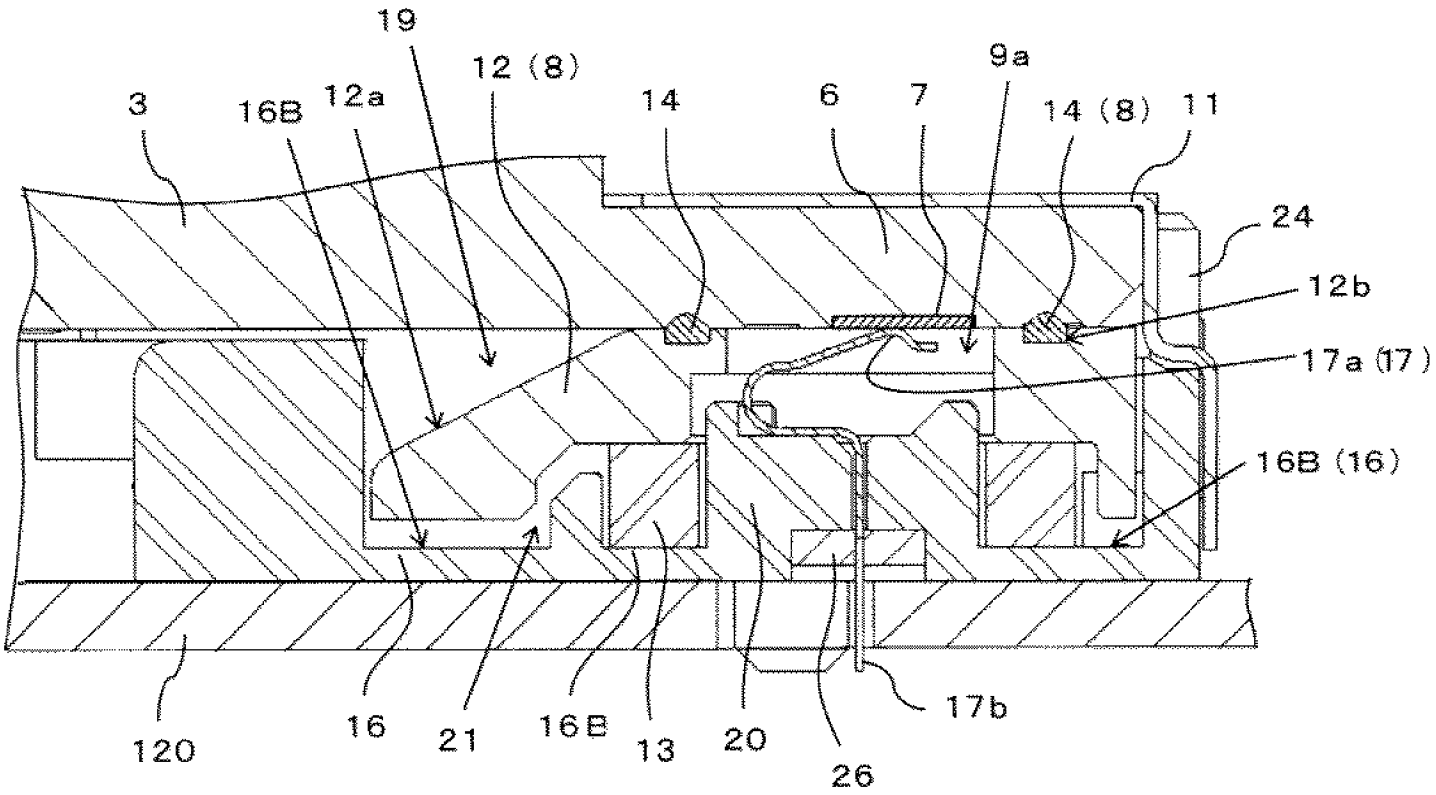
FIG. 13 is an enlarged longitudinal sectional view of main parts of FIG. 12.
Figure 14:
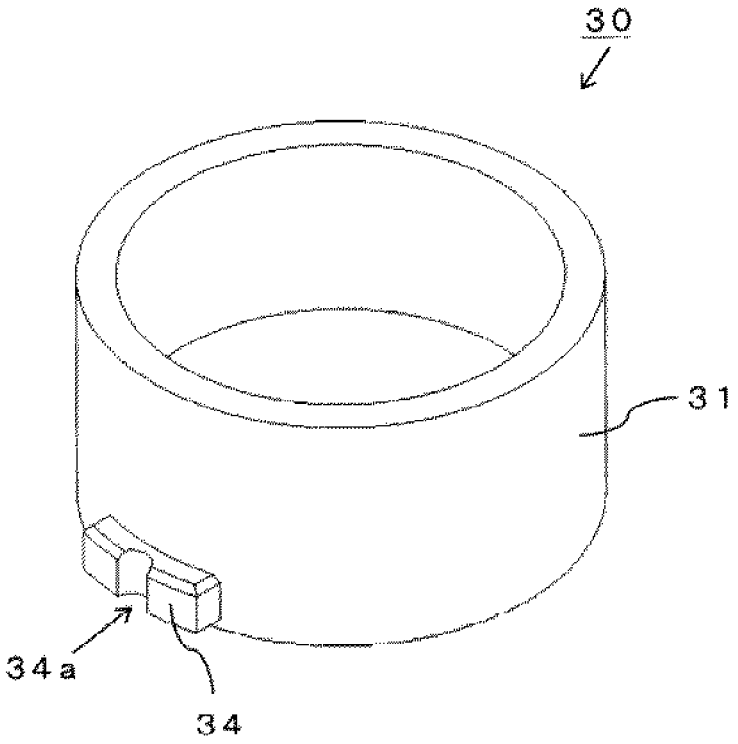
FIG. 14 is a perspective view of a counterpart optical electronic part 30 to be connected to a socket 40 according to a second embodiment of the present invention.
Figure 15:
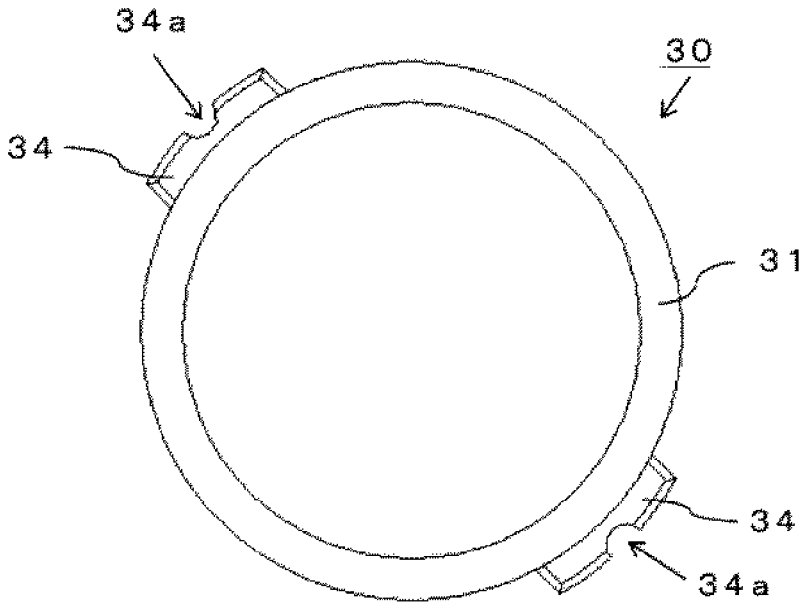
FIG. 15 is a plan view of the optical electronic part 30 with its internal structure omitted.

A rectangular groove 12*b* of narrow rectangular shape surrounding all the guide slits 9*a* of the insulating plate 9 is formed in the flat surface of the upper elastic ring frame unit 12. As shown in FIG. 13, a lower portion of the rectangular ring seal 14 formed in the same ring shape is pressed into the rectangular groove 12*b*, whereby the rectangular ring seal 14 is fixed. The oblong rectangular lower portion of the rectangular ring seal 14 is embedded in the upper elastic ring frame unit 12. The upper portion of the rectangular ring seal 14, having a semicircular cross section, is exposed upward from the flat surface of the upper elastic ring frame unit 12. The contact portions 17*a* of all the contacts 17 protrude into the accommodation recess 19 from inside the area surrounded by the rectangular ring seal 14.

The vertical distance between the rectangular ring seal 14 and the inner top surface of the metal cover 11 in the accommodation recess 19 is slightly smaller than the thickness of the plug connection portion 6. The plug connection portion 6 therefore compresses the lower elastic ring frame unit 13, the upper elastic ring frame unit 14, and the rectangular ring seal 14 while being inserted forward into the accommodation recess 19. To prevent the plug connection portion 6 inserted into the accommodation recess 19 from exceeding the connection position to protrude forward from the accommodation recess 19, a pair of stopper walls 24, 24 is provided on the front end of the base housing 16. The stopper walls 24, 24 are continuously formed inward on the front ends of the left and right guide walls 18, 18.

The metal cover 11 constituting the top surface of the accommodation recess 19 has a pair of arm portions 11*a*, 11*a* which cover the left and right guide walls 18, 18 from above, respectively. The arm portions 11*a*, 11*a* are integrally, continuously formed on the metal cover 11 to extend backward. The pair of arm portions 11*a*, 11*a* reinforces the thin guide walls 18, 18 to not be deformed easily. Ground leg portions 11*b*, 11*b* bent outward along the bottom surface of the base housing 16 in front and rear positions are soldered to a not-shown ground pattern of the printed wiring board 120. The socket 1 is thereby firmly fixed to the flat surface of the printed wiring board 120. The pair of engagement pieces 15, 15 is integrally cantilevered upward from the rear inner sides of the respective arm portions 11*a*, 11*a*. The pair of engagement pieces 15, 15 protrudes in positions where the engagement pieces 15, 15 fit into the engagement recesses 6*a* when the plug connection portion 6 is inserted to the connection position in the accommodation recess 19. By engaging the engagement pieces 15 with the engagement recesses 6*a*, the plug connection portion 6 is positioned in the connection position where the conductive pads 7 of the plug connection portion 6 and the contact portions 17*a* of the corresponding contacts 17 are in contact with each other.

Figure 8:
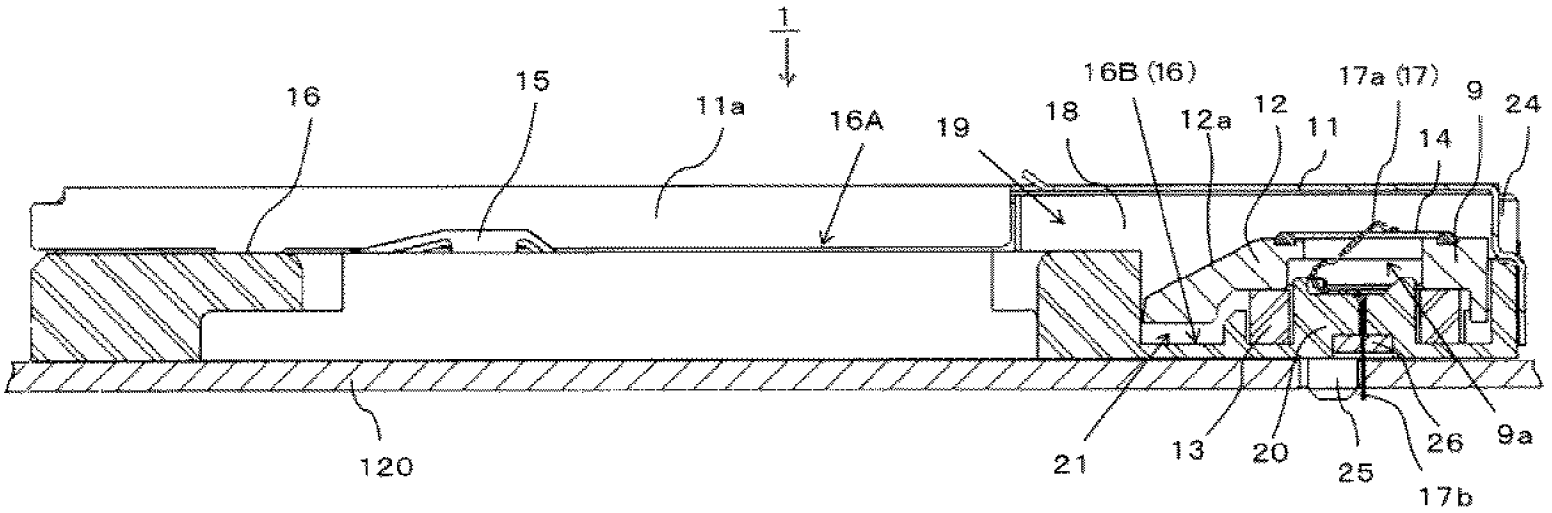
FIG. 8 is a longitudinal sectional view taken along the line A-A of FIG. 3 along a direction of insertion of a plug connection portion 6.

The large number of contacts 17 are fixed to the rib 20 of the base housing 16 at laterally constant insulating distances. As shown in FIG. 8, the contact portions 17*a* are folded obliquely upward and forward from the flat surface of the rib 20. As described above, the contact portions 17*a* are inserted through the guide slits 9*a* of the insulating plate 9 and the rectangular ring seal 14, and located in the interior of the accommodation recess 19. The contact portions 17*a* of the large number of contacts 17 protrude into the movement loci of the respective corresponding conductive pads 7 which slide inside the accommodation recess 19 in the front-to-rear direction along with the plug connection portion 6. The contact portions 17*a* make elastic contact with the corresponding conductive pads 7 exposed in the bottom surface of the plug connection portion 6 that is positioned in the connection position.

As shown in FIG. 8, the socket 1 includes a boss 25 which is perpendicularly provided on the bottom surface of the base housing 16. The boss 25 is inserted through a positioning hole in the printed wiring board 120, whereby the socket 1 is positioned on the flat surface of the printed wiring board 120. In the positioned state, leg portions 17*b* of the respective contacts 17 protruding downward from the rib 20 are inserted through through holes of the printed wiring board 120 and soldered to a not-shown corresponding signal pattern formed around. The foregoing ground leg portions 11*b* of the metal cover 11 are soldered to the ground pattern. A hermetic seal 26 for making close contact between the peripheries of the leg portions 17*b* of the contacts 17 and the base housing 16 is elastically attached to the positions where the leg portions 17*b* of the contacts 17 protrude from the bottom surface of the base housing 16. The hermetic seal 26 hermetically seals the gaps between the rib 20 and the leg portions 17*b*.

Figure 9:
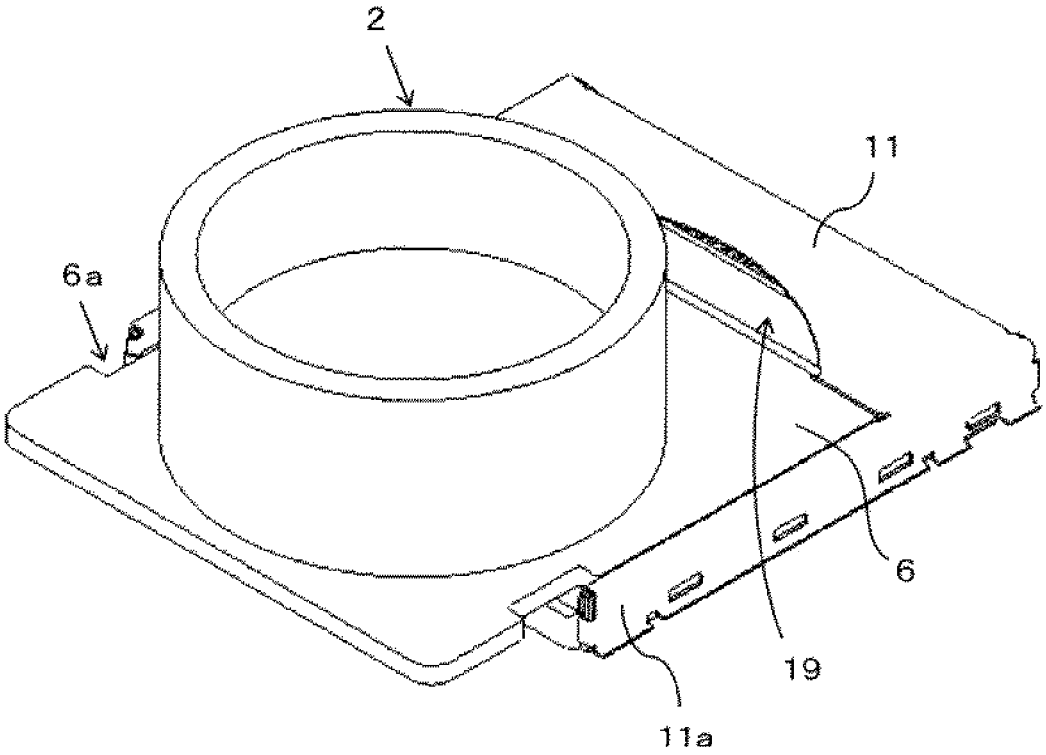
FIG. 9 is a perspective view of the socket 1, showing a state in which the optical electronic part 2 is placed on a part reception area 16A from above.
Figure 10:
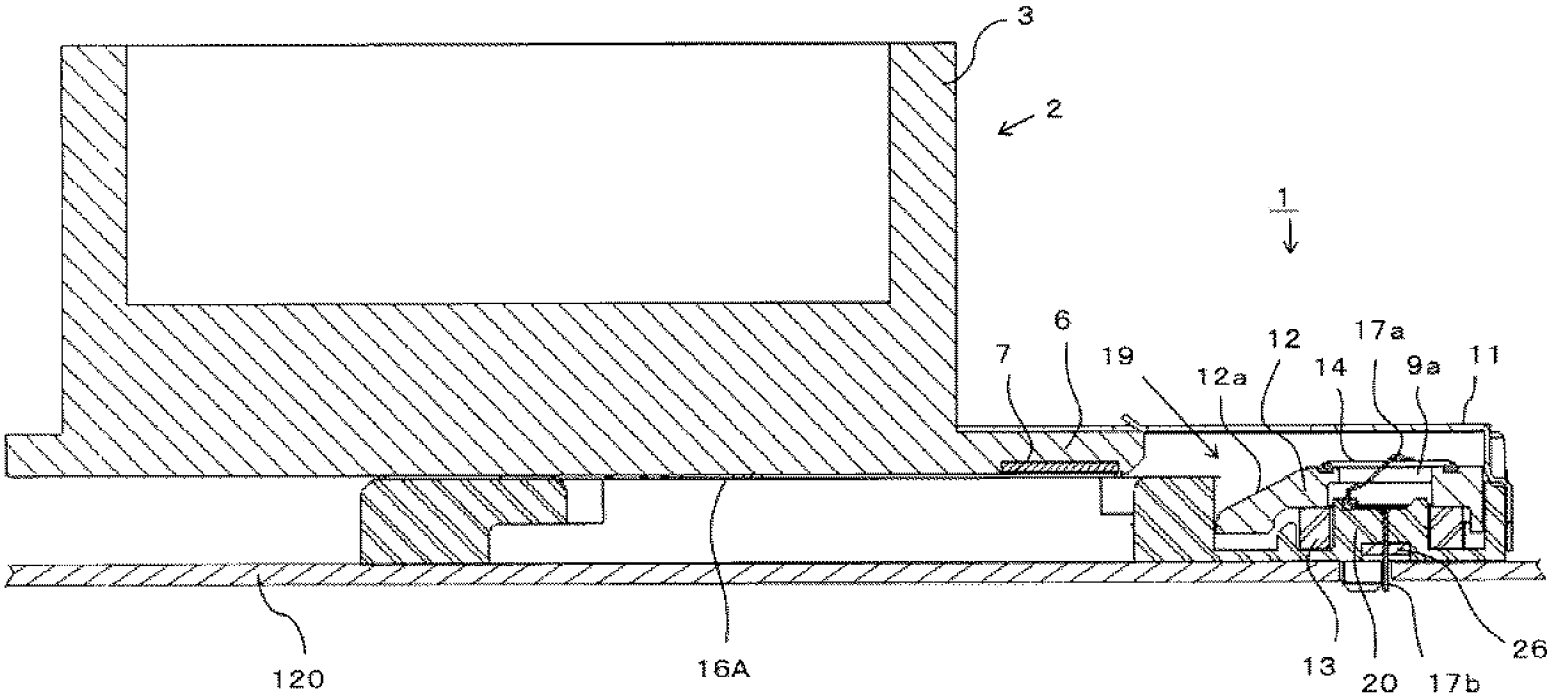
FIG. 10 is a longitudinal sectional view of FIG. 9, taken along the direction of insertion of the plug connection portion 6.
Figure 11:
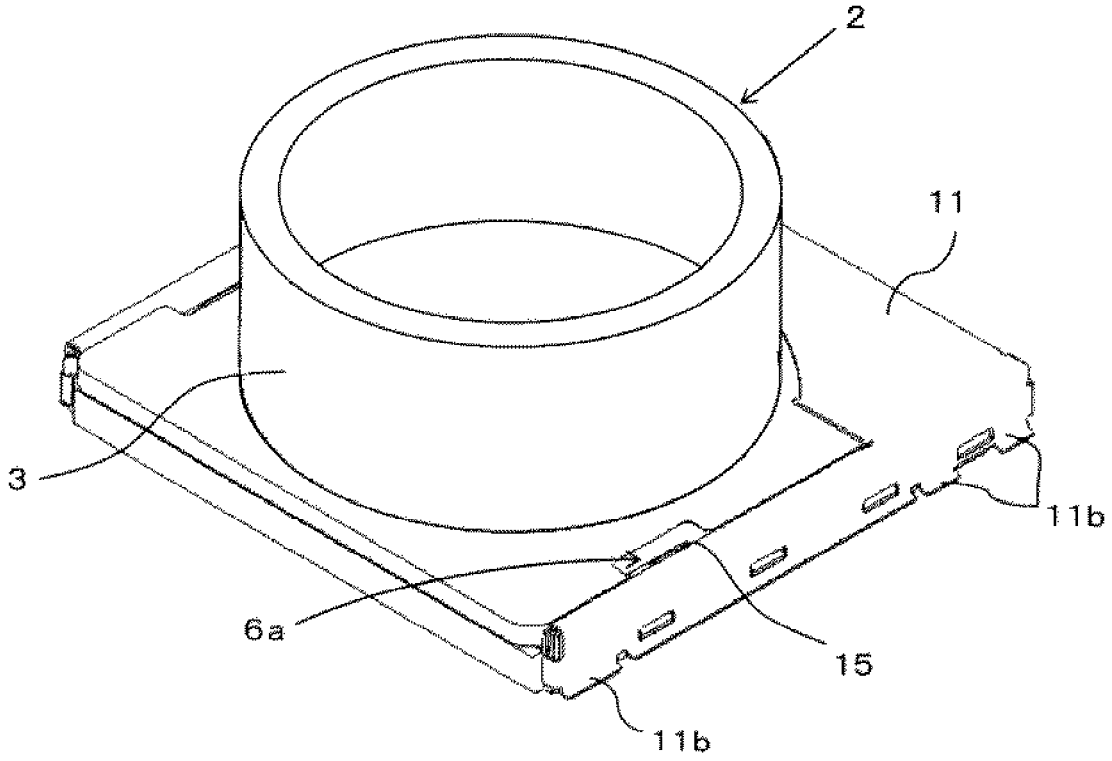
FIG. 11 is a perspective view of the socket 1, showing a state in which the plug connection portion 6 of the optical electronic part 2 is inserted to a connection position.

To connect the optical electronic part 2 to the socket 1 mounted on the printed wiring board 120, as shown in FIGS. 9 and 10, the optical electronic part 2 is placed on the part reception area 16A of the socket 1 from above with the side of the plug connection portion 6 where the conductive pads 7 are exposed in the bottom surface forward. The plug connection portion 6 is then slid forward along the guide walls 18 on both the left and right sides and inserted into the accommodation recess 19.

If the plug connection portion 6 is slid forward in the accommodation recess 19, the front end of the plug connection portion 6 comes into contact with the inclined surface 12*a* and presses down the upper elastic ring frame unit 12. If the front end of the plug connection portion 6 is further inserted up to the connection position shown in FIGS. 11 to 13 beyond the rectangular ring seal 14, the pair of engagement pieces 15, 15 is engaged with the engagement recesses 6*a* of the plug connection portion 6. The plug connection portion 6 is thereby positioned in the front-to-back direction. Since the contact portions 17*a* of all the contacts 17 are located in the same position in the front-to-rear direction of the accommodation recess 19, the pair of connection detection conductive pads 7*a*, 7*a* on both sides are first electrically connected to the contact portions 17*a* of the corresponding contacts 17 immediately before the plug connection portion 6 is slid to the connection position. Subsequently, the contact portions 17*a* of the contacts 17 corresponding to all the other conductive pads 7 make elastic contact from below for electrical interconnection. The timing of attachment and detachment of the optical electronic part 2 to/from the socket 1 can thus be detected from the electrical connection of the pair of connection detection conductive pads 7*a*, 7*a* with the contact portions 17*a* of the corresponding contacts 17.

In the connection position of the plug connection portion 6, the upper elastic ring frame unit 12, the lower elastic ring frame unit 13, and the rectangular ring seal 14 make compressive deformation, whereby the plug connection portion 6 inserted in the accommodation recess 19 is sandwiched between the rectangular ring seal 14 and the metal cover 11. The rectangular ring seal 14 is put in elastic and close contact with the bottom surface of the plug connection portion 6. As a result, the contact space in which all the conductive pads 7 and the contact portions 17*a* of the corresponding contacts 17 are in contact with each other is surrounded and hermetically sealed from outside by the bottom surface (exposure surface) of the plug connection portion 6, the elastic seal member 8 including the upper elastic ring frame unit 12, the lower elastic ring frame unit 13, and the rectangular ring seal 14, and the flat surface of the base housing 16.

The gaps between the leg portions 17*b* of the contacts 17 and the base housing 16 are also blocked by the hermetic seal 26. This prevents the intrusion of water or dust into the accommodation recess 19 from the bottom surface side of the housing 10.

To detach the plug connection portion 6 of the optical electronic part 2 in connection with the socket 1 from the accommodation recess 19, the plug connection portion 6 in the connection position is pulled backward against the elasticity of the engagement pieces 15 engaged with the engagement recesses 6*a*. The engagement recesses 6*a* and the engagement pieces 15 are thereby disengaged, and the plug connection portion 6 is moved backward to the part reception area 16A and then pulled up for removal.

In such a manner, the optical electronic part 2 can be easily attached and detached to/from the socket 1. Various different types of optical electronic parts 2 can thus be easily replaced according to the intended use. When the plug connection portion 6 is not connected to the socket 1, the space over the elastic seal member 8 is not covered with the plug connection portion 6. Water or dust getting into the foregoing connection space, if any, can thus be discharged from the opening of the elastic seal member 8.

The socket 1 according to the foregoing first embodiment is configured so that the plug connection portion 6 slides in the accommodation recess 19 straight in the front-to-rear direction. However, the present invention is also applicable to a case where a plug connection portion 31 rotates and slides about a center axis of a cylindrical accommodation recess 43 of a socket 40. Such a socket 40 according to a second embodiment of the present invention will be described below with reference to FIGS. 14 to 23.

Figure 16:
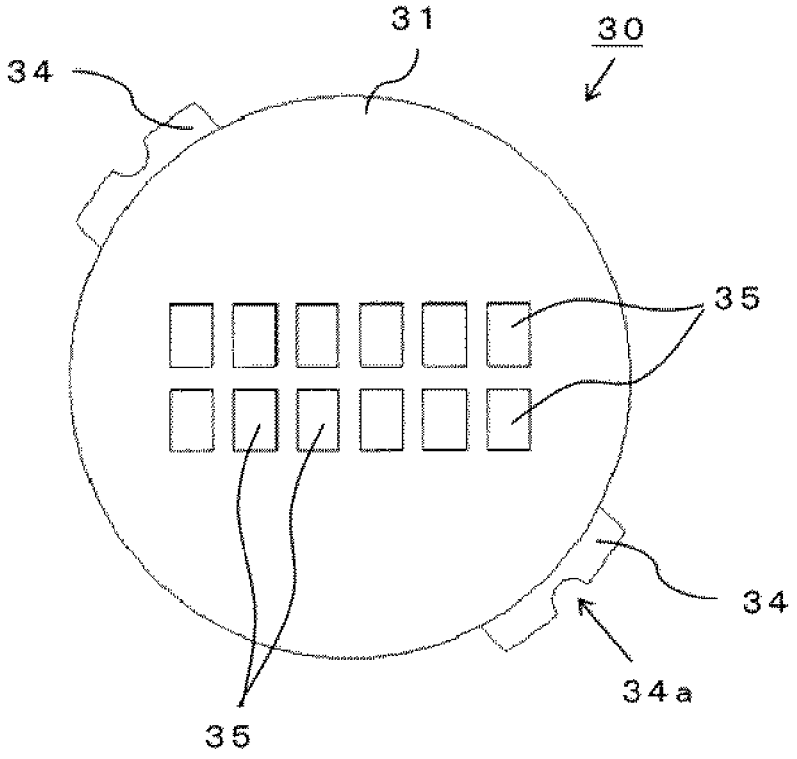
FIG. 16 is a bottom view of the optical electronic part 30.

An optical electronic part 30 to be connected to the socket 40 is a module in which a photoelectric conversion element and optical components (all of which are omitted in the diagrams) are accommodated in the plug connection portion 31 which includes a closed-bottomed cylindrical insulating case made of an insulating synthetic resin. As shown in FIG. 16, 12 conductive pads 35 serving as plug-side contacts for connecting to the photoelectric conversion element and the like are arranged in two rows in parallel in the bottom surface of the plug connection portion 31.

A pair of flange portions 34, 34 is horizontally protruded from the lower end of the cylindrical outer side surface of the plug connection portion 31, at intervals of 180° about the center axis of the cylinder. The outer side surfaces of the flange portions 34 are formed by a curved surface having approximately the same curvature as that of the curving inner wall surface of a cylindrical peripheral wall portion 46*a* of the socket 40 to be described later. The plug connection portion 31 is thereby rotatably guided about the center axis of the cylindrical peripheral wall portion 46*a*. Engagement recesses 34*a* for engagement protrusions 44 (see FIG. 18) protruded from the inner wall surface of the cylindrical peripheral wall portion 46*a* to be engaged with are formed in the centers of the curving outer side surfaces of the respective flange portions 34. By engaging the engagement protrusions 44 with the engagement recesses 34*a*, the rotation of the plug connection portion 31 rotatable about the foregoing center axis is positioned to a connection position which is a predetermined rotation position.

Figure 20:
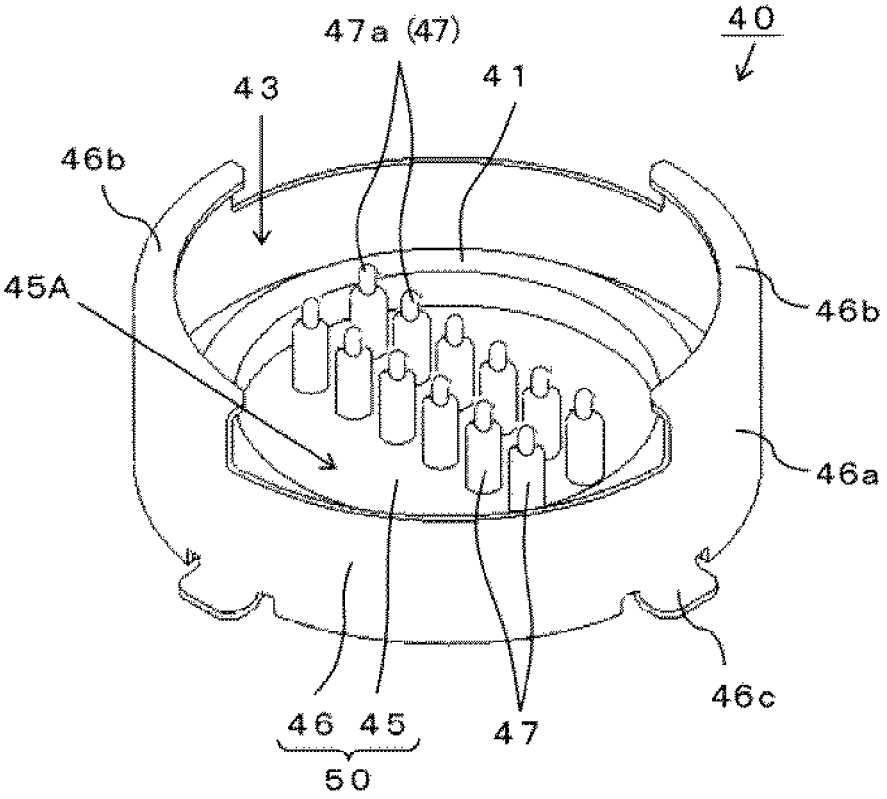
FIG. 20 is a perspective view of the socket 40 with an integral insulating ring 49 and an insulating plate 51 and a circular ring seal 42 removed.

As shown in FIG. 20, the socket 40 includes a housing 50 and a large number of socket-side contacts (hereinafter, referred to as contacts) 47. The housing 50 includes a disc-shaped circular bottom plate 45 made of a synthetic resin, and a cylindrical metal case 46 erected on the circular periphery of the circular bottom plate 45. The contacts 47 are passed through and fixed to the circular bottom plate 45. The cylindrical accommodation recess 43 in which the plug connection portion 31 of the optical electronic part 30 is rotatably accommodated from above is formed inside the housing 50 constituted by the circular bottom plate 45 and the metal case 46.

Figure 19:
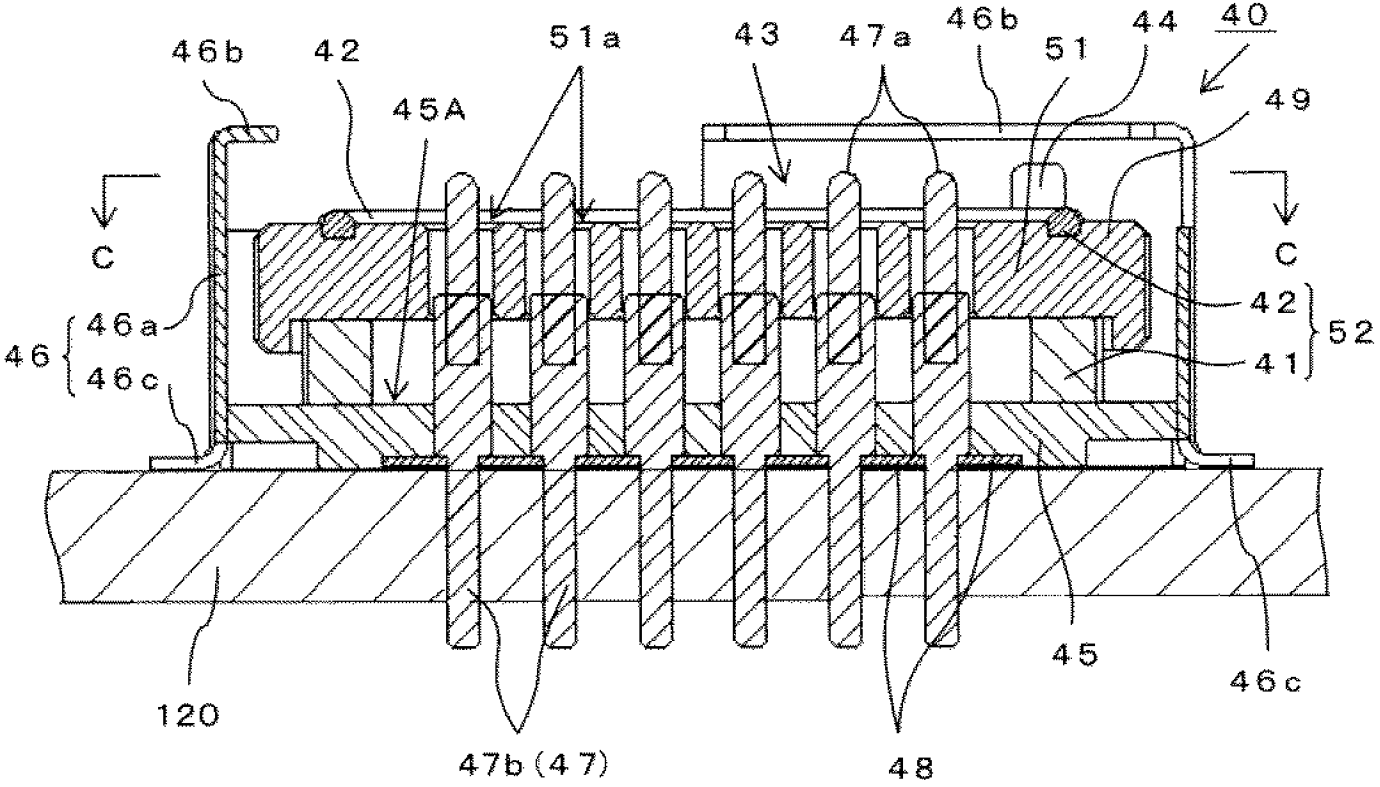
FIG. 19 is a cross sectional view of the socket 40, taken along the line B-B of FIG. 18.

The flat surface of the circular bottom plate 45 in the cylindrical accommodation recess 43 serves as a connection area 45A. The connection area 45A is perpendicularly opposed to the bottom surface of the plug connection portion 31 in which the conductive pads 35 are exposed. Twelve contacts 47 are passed through and fixed to the circular bottom plate 45 at regular insulating intervals. The contacts 47 are arranged in the connection area 45A in positions opposed to the respective 12 conductive pads 35, 35, . . . when the plug connection portion 31 is in a rotation position that is the connection position. As shown in FIG. 19, an elastic seal member 52 is arranged on the flat surface of the circular bottom plate 45, around the large number of contacts 47 planted in the connection area 45A. The elastic seal member 52 is formed by stacking ring frame members including a cylindrical elastic seal 41, an insulating ring 49, and a circular ring seal 42 in order from below.

In the present embodiment, the insulating ring 49 and an insulting plate 51 which covers an opening inside the ring are integrally molded of an insulating synthetic resin. The insulating ring 49 and the insulating plate 51 are not elastically deformable. The insulating plate 51 is opposed to the connection area 45A where the large number of contacts 47 are protruded into the cylindrical accommodation recess 43. The insulating plate 51 has circular guide holes 51*a* which are formed in positions where the respective large number of contacts 47 protrude. The large number of contacts 47 are thus inserted through the respective corresponding guide holes 51*a* and stand vertically to not be in contact with each other. If the insulating ring 49 is pressed down by the plug connection portion 31 accommodated in the cylindrical accommodation recess 43, contact pins 47*a* to be described later of the contacts 47 protrude relatively upward from through holes 49*a*.

A rectangular groove of circular configuration surrounding all the guide holes 51*a* is formed in the flat surface of the insulating ring 49. A lower portion of the circular ring seal 42 is pressed into the rectangular groove, whereby the circular ring seal 42 is fixed. The lower portion of the circular ring seal 42, having an oblong rectangular section, is embedded in the insulating ring 49. An upper portion having a semicircular section is exposed upward from the flat surface of the insulating ring 49. The contact pins 47*a* of all the contacts 47 are protruded into the cylindrical accommodation recess 43, inside the area surrounded by the circular ring seal 42.

As shown in FIG. 19, each contact 47 includes a contact main body 47*b* and a contact pin 47*a*. The contact main body 47*b* is passed through and fixed to the circular bottom plate 45. The contact pin 47*a* is biased upward and vertically movably attached to the contact main body 47*b* while being retained to not come off upward. Without external force, the contact pin 47*a* runs through a guide hole 51*a* of the insulating plate 51 and is located in the cylindrical accommodation recess 43. The respective contact pins 47*a* of all the contacts 47 thus protrude into the movement loci of the conductive pads 35 rotating about the center axis of the plug connection portion 31 in the cylindrical accommodation recess 43. The contact pins 47*a* make elastic contact from below with the corresponding conductive pads 35 exposed in the bottom surface of the plug connection portion 31 rotated to the connection position.

The portions of the contact main bodies 47*b* protruding downward through the circular bottom plate 45 serve as leg portions to be soldered to a corresponding signal pattern of the printed wiring board 120. A hermetic seal 48 is elastically attached to between the peripheries of the leg portions and the circular bottom plate 45, whereby the gaps of the circular bottom plate 45 through which the leg portions are passed are hermetically sealed.

Figure 17:
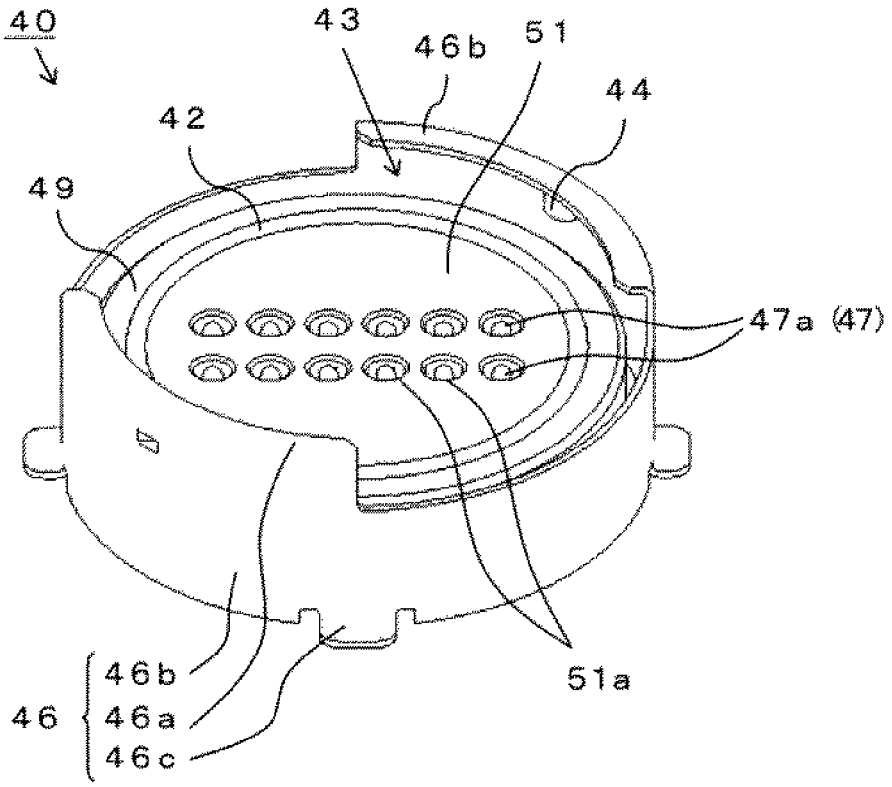
FIG. 17 is a perspective view of the socket 40 according to the second embodiment of the present invention.

As shown in FIG. 17, a pair of sector cover pieces 46*b*, 46*b* are formed on the top end of the cylindrical peripheral wall portion 46*a* of the metal case 46. The sector cover pieces 46*b*, 46*b* are protruded inward of the circular accommodation recess 43 at distances of 90° about the center axis of the cylindrical peripheral wall portion 46*a*. The inner diameter between the pair of sector cover pieces 46*b*, 46*b* is smaller than the outer diameter across the pair of flange portions 34, 34 of the plug connection portion 31. The vertical distance between the circular ring seal 42 in a free state and the sector cover pieces 46*b* is smaller than the height from the bottom surface of the plug connection portion 31 to the flat surfaces of the flange portions 34. The pair of sector cover pieces 46*b*, 46*b*, the cylindrical peripheral wall portion 46*a*, and the elastic seal member 52 thus constitute a bayonet coupling mechanism which couples the plug connection portion 31 of the optical electronic part 30 to the cylindrical accommodation recess 43 of the socket 40.

More specifically, the plug connection portion 31 is lowered into the cylindrical accommodation recess 43 in a rotation position in which the pair of sector cover pieces 46*b*, 46*b* does not interfere with the flange portions 34. The bottom surface of the plug connection portion 31 moves the contact pins 47*a* down, and then presses down the circular ring seal 42 to compressively deform the cylindrical elastic seal 41 and the circular ring seal 42 of the elastic seal member 52. In such a state, the plug connection portion 31 is rotated about the center axis up to a position where the flange portions 34 come vertically under the sector cover pieces 46*b*. The flange portions 34 biased upward by the elasticity of the elastic seal member 52 make contact with the bottom surfaces of the sector cover pieces 46*b*, whereby the plug connection portion 31 is coupled to the cylindrical accommodation recess 43 with its bottom surface in elastic contact with the circular ring seal 42.

Figure 18:
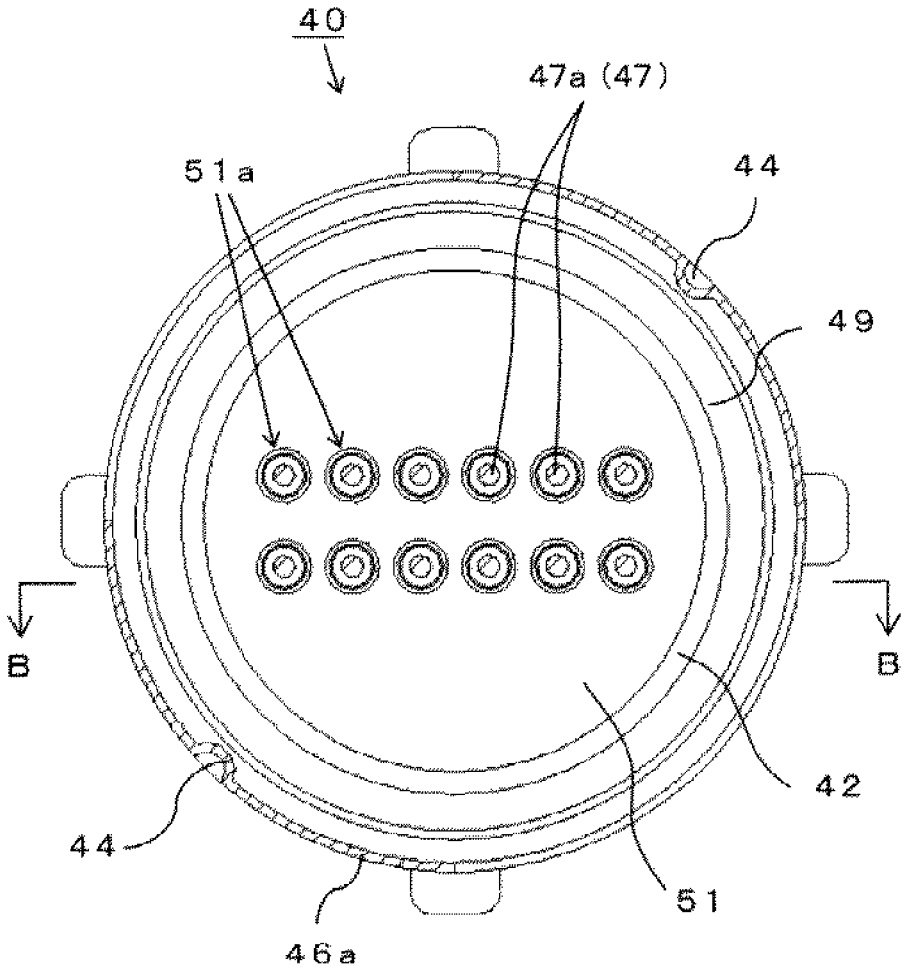
FIG. 18 is a cross sectional view of the socket 40, taken along the line C-C of FIG. 19.

As shown in FIGS. 17 and 18, the pair of engagement protrusions 44, 44 to be engaged with the engagement recesses 34*a* of the flange portions 34 is formed by inwardly embossing the metal plate in the portions of the cylindrical peripheral wall portion 46*a* falling on the intermediate positions of the sector cover pieces 46*b* about the center axis. The rotation position in which the flange portions 34 are in contact with the centers of the bottom surfaces of the sector cover pieces 46*b* is thus determined as the connection position in which the plug connection portion 31 is positioned in the direction of rotation. In this connection position, the contact pins 47*a* of the contacts 47 protruding into the cylindrical accommodation recess 43 make elastic contact with the respective corresponding conductive pads 7 exposed in the bottom surface of the plug connection portion 31.

FIG. 19 shows the socket 40 mounted on the printed wiring board 120. The leg portions of the contacts 47 protruding downward from the circular bottom plate 45 are inserted through through holes of the printed wiring board 120, and soldered to a not-shown corresponding signal pattern formed around. Ground leg portions 46*c*, 46*c* formed by bending the lower end of the cylindrical peripheral wall portion 46*a* of the metal case 46 outward along a horizontal plane in four positions are soldered to a not-shown ground pattern of the printed wiring board 120.

Figure 21:
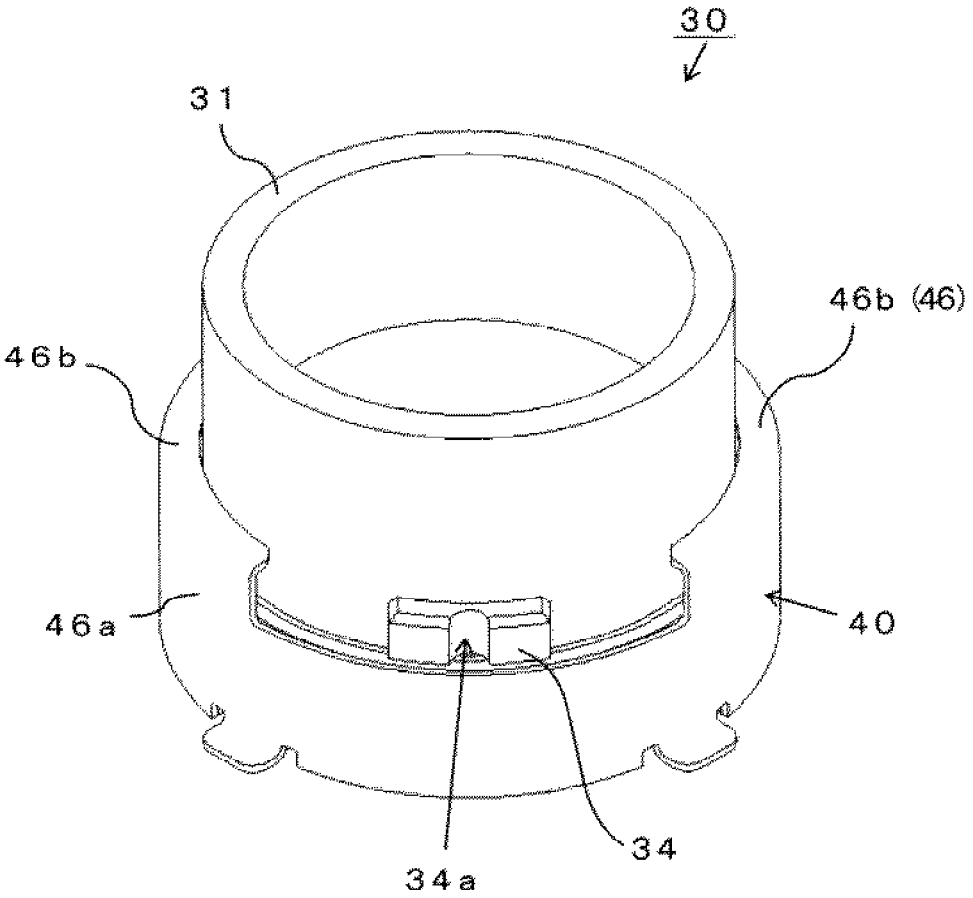
FIG. 21 is a perspective view of the socket 40, showing a state in which the optical electronic part 30 is accommodated into a cylindrical accommodation recess 43 from above.
Figure 22:
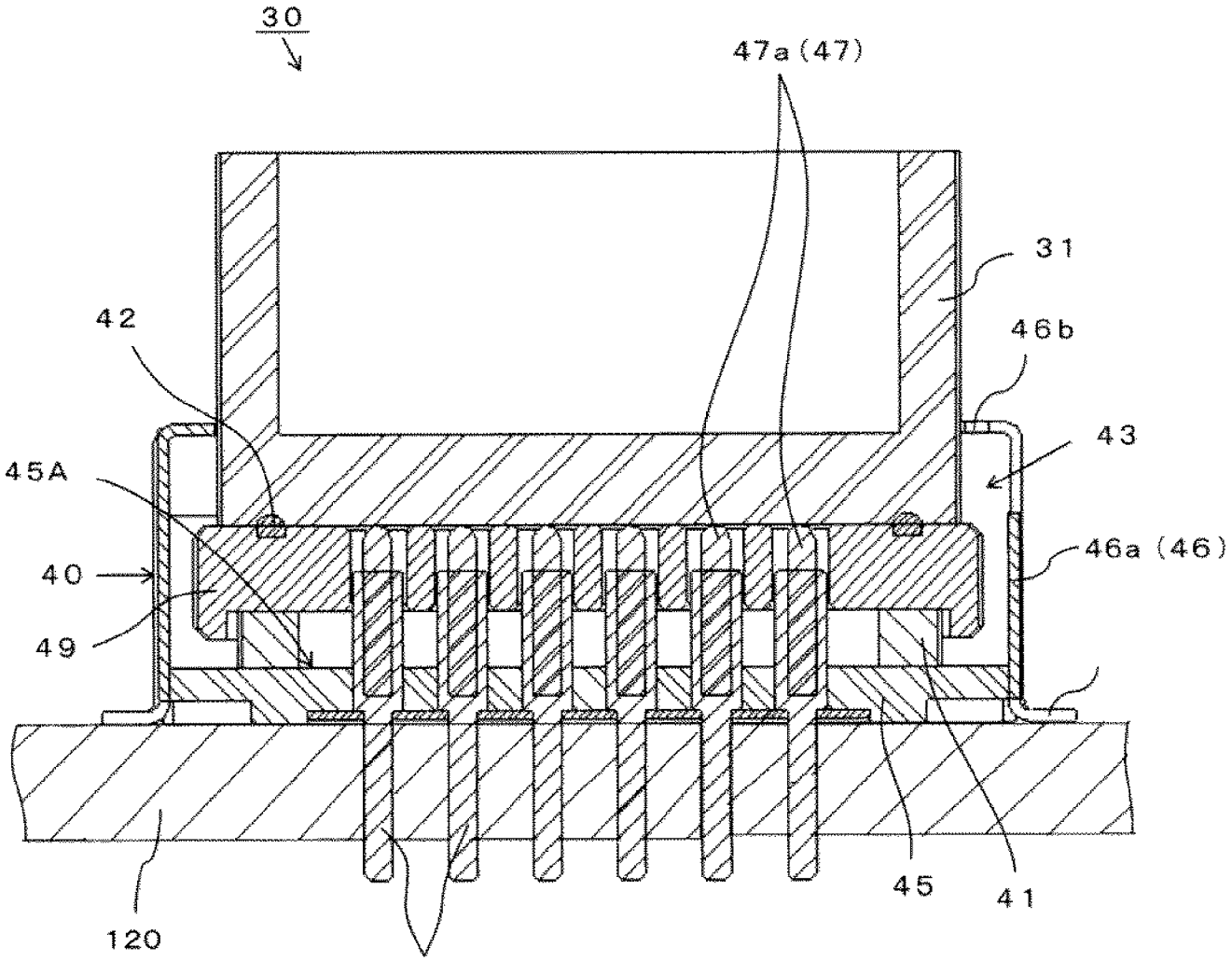
FIG. 22 is a longitudinal sectional view of the state of FIG. 21, taken along the line B-B of FIG. 18.
Figure 23:
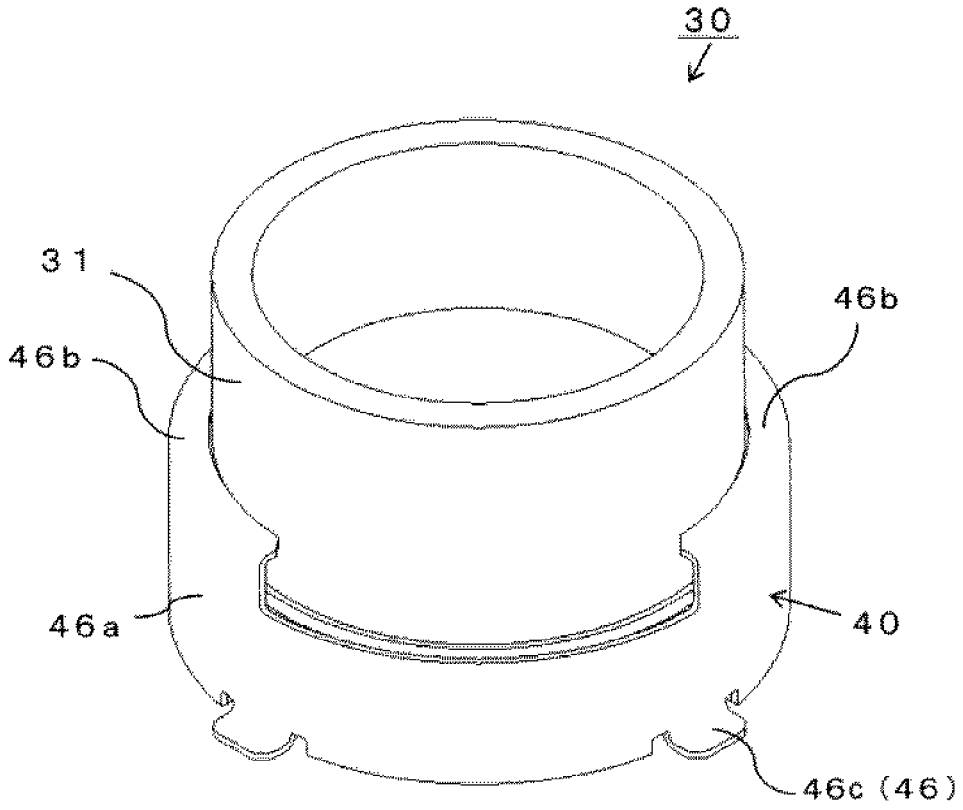
FIG. 23 is a perspective view of the socket 40, showing a state in which a plug connection portion 32 of the optical electronic part 30 is rotated to a connection position.
Figure 24A:
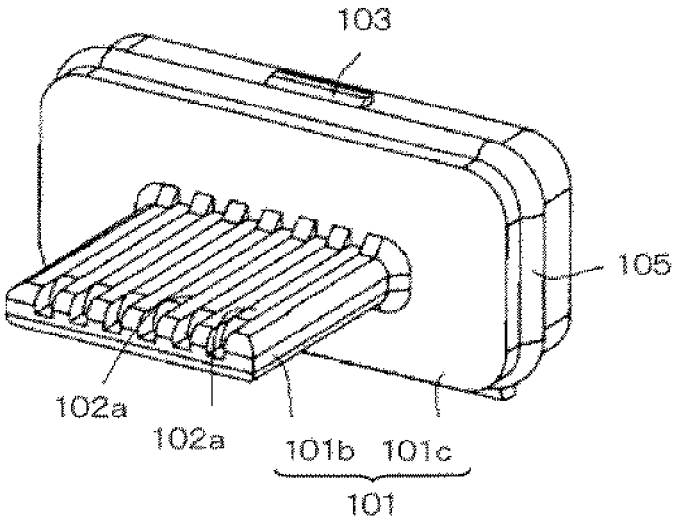
(RELATED ART) FIG.24A
FIG. 24A is a perspective view obliquely from the front of a partition plate 101*c* of a related socket 100 to be connected with an optical electronic part.
Figure 24B:
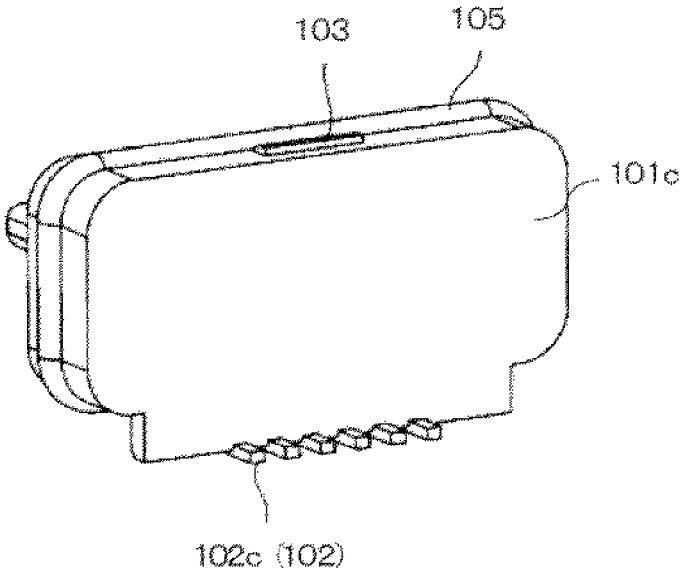
(RELATED ART) FIG.24B
FIG. 24B is a perspective view obliquely from behind of the partition plate 101*c*.
Figure 25:
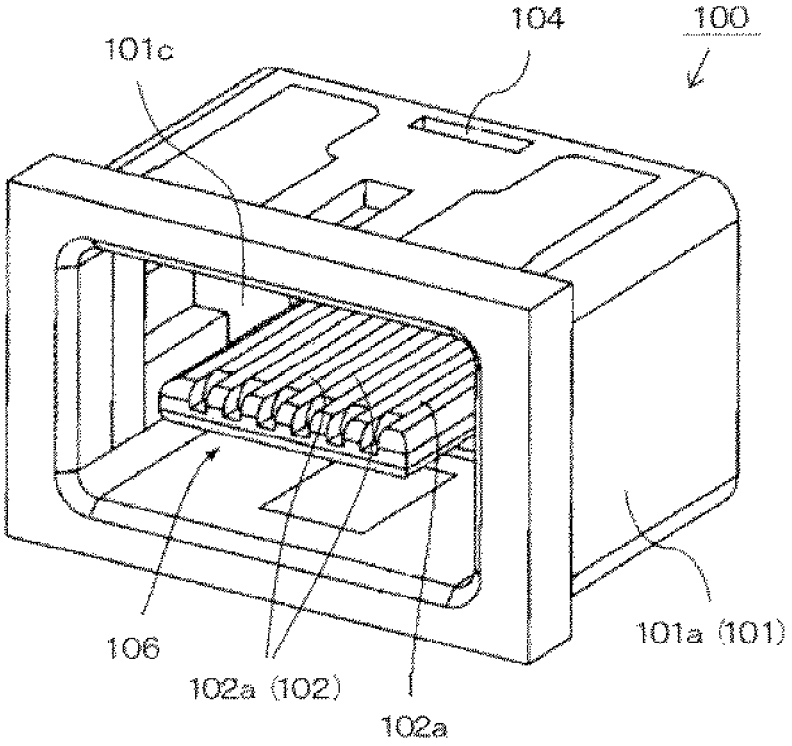
(RELATED ART) FIG.25
FIG. 25 is a longitudinal sectional view of the socket 100.

To connect the optical electronic part 30 to the socket 40, as shown in FIGS. 21 and 22, the contact pins 47*a* and the elastic seal member 52 are pressed down and compressed by the bottom surface of the plug connection portion 31 that is put in a rotation position in which the flange portions 34 do not overlap with the sector cover pieces 46*b*. The plug connection portion 31 is then rotated about the center axis of the cylindrical accommodation recess 43 up to the connection position where the engagement protrusions 44 and the engagement recesses 34*a* are engaged with each other.

In the connection position, the plug connection portion 31 is retained to not come off the cylindrical accommodation recess 43 upward, and the rotation about the center axis is restricted. The contact pins 47*a* of the 12 contacts 47 protruding upward from the guide holes 51*a* make elastic contact with the respective 12 conductive pads 35, 35, . . . exposed in the bottom surface, whereby the optical electronic part 30 is electrically connected to the printed wiring board 120 via the contacts 47. In such a connection position, the compressively-deformed circular ring seal 42 is in elastic close contact with the bottom surface of the plug connection portion 31 surrounding the positions in which the conductive pads 35 are exposed. The contact space in which the conductive pads 35 and the contact pins 47*a* of the contacts 47 are in contact with each other is surrounded and hermetically sealed from outside by the bottom surface of the plug connection portion 31, the elastic seal member 52 including the circular ring seal 42, the insulating ring 49, and the cylindrical elastic seal 41, and the flat surface of the circular bottom surface 45.

To detach the plug connection portion 31 in connection with the socket 40 from the cylindrical accommodation recess 43, the plug connection portion 31 in the connection position is rotated to a position where the flange portions 34 do not overlap with the sector cover pieces 46*b*, against the elasticity of the engagement protrusions 44 engaged with the engagement recesses 34*a*. The plug connection portion 31 is then pulled up from the cylindrical accommodation recess 43. In such a manner, the optical electronic part 30 can be easily attached and detached to/from the socket 40. Various different types of optical electronic parts 30 can thus be easily replaced according to the intended use.

In the foregoing embodiments, the elastic seal members 8 and 52 are formed by stacking a plurality of ring frame members. However, the elastic seal members 8 and 52 may be constituted by a ring frame member including a single elastic body.

Like the insulating ring 52 according to the second embodiment, part of the plurality of ring frame members may be made of a rigid body as long as the entire elastic seal member is elastic.

The housing having the accommodation recess may be formed in part by bending a metal plate as long as the plurality of socket-side contacts are not short-circuited.

If the contacts are insert-molded with the housing without a gap between the contacts and the passages of the contacts, no sealing material is needed for sealing.

An embodiment of the present invention is suitable for a socket of which socket-side contacts are connected with plug-side contacts of a plug connection portion in an inferior environment.

REFERENCE SIGNS LIST

1 socket
2 electronic part (counterpart part)
6 plug connection portion (flange portion)
7 conductive pad (plug-side contact)
8 elastic seal member
8 insulating plate
9*a* guide slit (guide hole)
10 housing
12 upper elastic ring frame unit
12*a* inclined surface
13 lower elastic ring frame unit
14 rectangular ring seal
16B connection area
17 contact (socket-side contact)
17*a* contact portion
19 accommodation recess
26 hermetic seal (sealing material)
31 plug connection portion
35 conductive pad (plug-side contact)
40 socket
41 cylindrical elastic seal
42 circular ring seal
43 cylindrical accommodation recess
45 circular bottom plate
45A connection area
46 metal case
46*a* cylindrical peripheral wall portion
46*b* sector cover piece
47 contact (socket-side contact)
47*a* contact pin

48 hermetic seal
49 insulating ring
50 housing
51 insulating plate
51*a* guide hole
52 elastic seal member

The invention claimed is:

1. A socket comprising:

a housing including both a cover and a base, and in which an accommodation recess is formed, the accommodation recess accommodating a counterpart plug connection portion having one or a plurality of plug-side contacts exposed in one surface in a freely slidable manner along the one surface as an exposure surface of the plug connection portion;

one or a plurality of socket-side contact(s) that is/are passed through a connection area of an inner surface of the accommodation recess and fixed to the housing, the inner surface being opposed to the exposure surface of the plug connection portion in the accommodation recess, the plug-side contact(s) exposed in the exposure surface of the plug connection portion slide to a connection position in the accommodation recess to be put in contact with a contact portion or portions of corresponding socket-side contact(s) protruding from the connection area into the accommodation recess; and an elastic seal member that surrounds the one or plurality of socket-side contacts fixed to the connection area, is fixed to the inner surface of the accommodation recess, and makes elastic contact with the exposure surface of the plug connection portion accommodated in the accommodation recess, wherein a contact space in which the plug-side contact(s) of the plug connection portion slide to the connection position in the accommodation recess and the contact portion(s) of the corresponding socket-side contact(s) make elastic contact with each other is surrounded and hermetically sealed by the inner surface of the accommodation recess, the elastic seal member, and the exposure surface of the plug connection portion, and the cover of the housing is fixed to the base in a closed position before the plug-side contacts slide to the connection position.

2. The socket according to claim 1, wherein:

either one of a flat surface and a bottom surface of the plug connection portion formed in a plate shape along a direction of insertion into the accommodation recess serves as the exposure surface;

the accommodation recess guides and accommodates the plug connection portion inserted in the direction of insertion up to the connection position in parallel with the exposure surface; and the contact space in which the plug-side contact(s) of the plug connection portion inserted to the connection position in the accommodation recess and the contact portion(s) of the corresponding socket-side contact(s) are in contact with each other is surrounded and hermetically sealed by the inner surface of the accommodation recess, the elastic seal member, and the exposure surface of the plug connection portion.

3. The socket according to claim 2, wherein:

an inclined surface sloping toward the exposure surface of the plug connection portion along the direction of insertion of the plug connection portion is formed on a front surface of the elastic seal member facing the plug connection portion inserted into the accommodation recess.

4. The socket according to claim 2, wherein:

an opposed surface opposed to the inner surface in the accommodation recess is a metal cover formed by a bent conductive metal plate.

5. The socket according to claim 1, wherein:

the plug connection portion includes a cylindrical body that has a cylindrical outer side surface having a flange portion protruded thereon and a bottom surface serving as the exposure surface;

the housing includes a cylindrical accommodation recess that rotatably guides and accommodates the plug connection portion about a center axis thereof and a cover that protrudes into the cylindrical accommodation recess on a flat surface side of the flange portion of the plug connection portion rotated to a connection position in the cylindrical accommodation recess, the cylindrical accommodation recess and the cover being formed out of a circular bottom surface portion that has an inner bottom surface serving as the inner surface opposed to the exposure surface and a cylindrical peripheral wall portion that is erected around the circular bottom surface portion; and the contact space in which the plug-side contact(s) of the plug connection portion rotated to the connection position in the cylindrical accommodation recess and the contact portion(s) of the corresponding socket-side contact(s) are in contact with each other is surrounded and hermetically sealed by the inner bottom surface of the cylindrical accommodation recess, the elastic seal member, and the exposure surface of the plug connection portion.

6. The socket according to claim 5, wherein the cover is a metal cover formed by a bent conductive metal plate.

7. A socket comprising:

a housing in which an accommodation recess is formed, the accommodation recess accommodating a counterpart plug connection portion having one or a plurality of plug-side contacts exposed in one surface in a freely slidable manner along the one surface as an exposure surface of the plug connection portion;

one or a plurality of socket-side contact(s) that is/are passed through a connection area of an inner surface of the accommodation recess and fixed to the housing, the inner surface being opposed to the exposure surface of the plug connection portion in the accommodation recess, the plug-side contact(s) exposed in the exposure surface of the plug connection portion slide to a connection position in the accommodation recess to be put in contact with a contact portion or portions of corresponding socket-side contact(s) protruding from the connection area into the accommodation recess; and an elastic seal member that surrounds the one or plurality of socket-side contacts fixed to the connection area, is fixed to the inner surface of the accommodation recess, and makes elastic contact with the exposure surface of the plug connection portion accommodated in the accommodation recess, wherein a contact space in which the plug-side contact(s) of the plug connection portion slide to the connection position in the accommodation recess and the contact portion(s) of the corresponding socket-side contact(s) make elastic contact with each other is surrounded and hermetically sealed by the inner surface of the accommodation recess, the elastic seal member, and the exposure surface of the plug connection portion, the elastic seal member is formed by a stacked plurality of ring frame members each surrounding the one or plurality of socket-side contacts fixed to the connection area; and any one of the ring frame members integrally includes an insulating plate that covers the connection area inside which is surrounded by the ring frame member, the insulating plate having one or a plurality of guide holes for the one or plurality of socket-side contacts protruding from the connection area into the accommodation recess to be inserted through, respectively.

8. A socket comprising:

a housing in which an accommodation recess is formed, the accommodation recess accommodating a counterpart plug connection portion having one or a plurality of plug-side contacts exposed in one surface in a freely slidable manner along the one surface as an exposure surface of the plug connection portion;

one or a plurality of socket-side contact(s) that is/are passed through a connection area of an inner surface of the accommodation recess and fixed to the housing, the inner surface being opposed to the exposure surface of the plug connection portion in the accommodation recess, the plug-side contact(s) exposed in the exposure surface of the plug connection portion slide to a connection position in the accommodation recess to be put in contact with a contact portion or portions of corresponding socket-side contact(s) protruding from the connection area into the accommodation recess; and an elastic seal member that surrounds the one or plurality of socket-side contacts fixed to the connection area, is fixed to the inner surface of the accommodation recess, and makes elastic contact with the exposure surface of the plug connection portion accommodated in the accommodation recess, wherein a contact space in which the plug-side contact(s) of the plug connection portion slide to the connection position in the accommodation recess and the contact portion(s) of the corresponding socket-side contact(s) make elastic contact with each other is surrounded and hermetically sealed by the inner surface of the accommodation recess, the elastic seal member, and the exposure surface of the plug connection portion, and a gap between a leg portion or portions of the socket-side contact(s) and the housing is sealed by a sealing material, the leg portion(s) being passed through an outer surface of the housing from the contact area of the inner surface of the accommodation recess and fixed to the housing.

* * * * *